US011554277B2

(12) United States Patent
Fabbi

(10) Patent No.: US 11,554,277 B2
(45) Date of Patent: Jan. 17, 2023

(54) FALL PROTECTION SYSTEM

(71) Applicant: Unified Safety Inc., Kelowna (CA)

(72) Inventor: Christopher Fabbi, Kelowna (CA)

(73) Assignee: Unified Safety Inc., Kelowna (CA)

( * ) Notice: Subject to any disclaimer, the term of this patent is extended or adjusted under 35 U.S.C. 154(b) by 57 days.

(21) Appl. No.: 17/003,871

(22) Filed: Aug. 26, 2020

(65) Prior Publication Data

US 2022/0062676 A1 Mar. 3, 2022

(30) Foreign Application Priority Data

Aug. 25, 2020 (CA) ..... CA 3091065

(51) Int. Cl.
*A62B 35/00* (2006.01)
*A62B 35/04* (2006.01)

(52) U.S. Cl.
CPC ..... *A62B 35/0068* (2013.01); *A62B 35/04* (2013.01)

(58) Field of Classification Search
CPC ..... A62B 35/0068; A62B 35/04
See application file for complete search history.

(56) References Cited

U.S. PATENT DOCUMENTS 4,249,713 A * 2/1981 Glynn ..... A62B 35/04 248/237
5,287,944 A * 2/1994 Woodyard ..... A62B 35/04 182/3
6,668,509 B1 * 12/2003 Krebs ..... E04D 13/12 52/698
6,786,020 B2 * 9/2004 Poldmaa ..... E04D 13/12 52/704
6,823,799 B2 * 11/2004 Gleave ..... E04D 13/10 104/111
7,665,248 B2 * 2/2010 Blackford ..... E04D 13/12 52/27
9,744,387 B1 * 8/2017 Hung ..... A62B 35/0068
2020/0392748 A1 * 12/2020 Fabbi ..... A62B 35/0062

FOREIGN PATENT DOCUMENTS

| | | |
|---|---|---|
| EP | 0 593 150 | 4/1994 |
| GB | 2 328 664 | 3/1999 |
| WO | WO2002/044496 | 6/2002 |
| WO | WO2006/021794 | 3/2006 |
| WO | WO2013/159888 | 1/2014 |
| WO | WO 2019/161496 | 8/2019 |

* cited by examiner

*Primary Examiner* — Anita M King
(74) *Attorney, Agent, or Firm* — Critical Path IP Law, LLC

(57) ABSTRACT

A fall protection system having one or more modules is provided. Each module is made of a structural sheet having a ridge and at least one attachment panel, and a user attachment mechanism. The attachment panel can be secured to a working structure. The module can further have a restraining mechanism for resisting at least lateral and rotational movement of the ridge up to a threshold force, and be configured to fail or deform and permit lateral and rotational movement of the ridge if the threshold force is exceeded. The restraining mechanism can be tabs extending from the attachment panel, fasteners, welds, or another mechanism for resisting lateral and rotational movement of the ridge.

26 Claims, 25 Drawing Sheets

FALL PROTECTION SYSTEM

CROSS REFERENCE

This application claims priority to Canadian Patent Application No. 3,091,065 entitled "Fall Protection System" filed Aug. 25, 2020, which is hereby incorporated by reference in its entirety.

FIELD OF THE INVENTION

The present disclosure relates to a fall protection system for installation on elevated structures and buildings and more particularly, on roofs of buildings.

BACKGROUND OF THE INVENTION

Operative access to elevated working structures, such as roof areas, is a major source of danger during building construction, inspection, and maintenance procedures, especially on sloping roofs. Falls from elevated working structures are a common contributor to injuries and fatalities. Fall protection systems are therefore used to mitigate the risks of such accidents. Known fall protection systems fall into two main categories: (i) discrete points and/or (ii) continuous coverage. Individual anchors fall in the first category and cable safety systems and safety rail systems are in the second category.

Individual anchor points are mounted to the underlying structure and provide a single point that can restrain a worker from encountering a fall, arrest a worker's fall, and may also be used for suspending a worker or equipment. Individual anchor points are typically lower cost relative to continuous anchor systems. However, they do not allow for continuous protection as a worker moves about the roof, as the worker must engage and disengage with the individual anchor points as she moves about the structure. Further, due to the worker's safety line forming a fixed radius from the anchor point, not all areas of the structure are accessible in a fall restraint application. Further, the potential for a swing fall hazard exists if the worker is utilizing the anchor point in a fall arrest situation with too great of an offset from the anchor.

Cable safety systems are installed on working structures via end posts and intermediate posts supporting the cable at regular intervals. A cable safety system is able to permit a user access to large areas of a working structure such as a roof, and enables a user to change direction to access a particular region of the working structure without the need to detach from the safety system. However, when a load is applied to the cable by a person attached to a safety line, such as in the event of a fall, the load is primarily transferred through the cable into the posts and so into the working structure, such as a roof. The loads are typically very high and can potentially damage the working structure. The use of cable safety systems is also limited by the cable deflection that occurs when a person falls. This restricts the use of cable systems on relatively low-level structures as a user may impact the ground before their fall is arrested by the system, or system deflection may permit the user to fall when in a travel restraint situation.

Known safety rail systems comprise a safety rail or track to which a safety rail traveler and associated safety line may be attached. Safety rail systems use a solid beam or track and typically have a low profile when mounted. EP 0 593 150 describes a roof safety system in which a rail is provided at the ridge of a pitched roof. A traveler, such as that disclosed in GB 2 328 664, is slidably mounted on the rail, so that a person working on either side of the pitched roof can secure a safety line to the traveler for protection from falling off the roof. Although rail and traveler systems provide the advantage of an attachment point which is easily moved to any position along the length of a roof ridge, the prior art roof safety systems require special fixings and are not readily retrofitted to an existing roof or other working structure.

Further, most cable and rail systems are not approved for use or are not permitted in many jurisdictions for the in-air suspension of workers. A boatswain's chair is an example of such a system.

Moreover, many existing fall protection systems do not have waterproofing integrated into their designs.

WO2002/044496 discloses a safety rail system which can be installed on a sloping roof and provides a continuous rail to which a safety rail traveler and associated safety line may be attached. The system comprises one or more longitudinal base units, of substantially uniform cross section adapted to be fixed to the surface of a roof, and one or more longitudinal rail units of substantially uniform cross section adapted to allow the attachment of a safety rail traveler.

WO2006/021794 discloses a safety rail system that includes at least two rail members arranged end-to-end and a spigot securing together adjacent rail members.

WO2013/159888 discloses an integrated safety system for roofers of buildings comprising an elongate ridge cap having a profile along the top adapted to provide a track for a shuttle.

There is a need for a fall protection system which provides the system design with flexibility and enables a user to access large areas of a working structure without detachment from the system; which can safely suspend a worker in the air; which selectively allows suspension or fall protection at a discrete location or provides continuous coverage, either provided as standalone options or within the same system design; which can be easily and permanently installed on a new roof or retrofitted to an existing roof; which can be easily replaced in parts when necessary; which includes integrated means for waterproofing; which may include integrated means for ventilation if desired; and which may mitigate damage to the working structure in the event of a fall.

SUMMARY OF THE INVENTION

The present disclosure aims to provide a fall protection system that overcomes the drawbacks of conventional systems and allows a flexible system that has the ability to incorporate select or combined safety systems on a common mounting platform. The fall protection system comprises one or more modules to which a discrete anchor point and/or a continuous coverage system such as a cable or rigid rail system may be attached. Each module is made of a structural sheet having a ridge and at least one attachment panel, and a user attachment mechanism such as an anchor connector, rail, or cable. The attachment panel can be secured to a working structure. The module can further have a restraining mechanism for resisting at least rotational and lateral movement of the ridge up to a threshold force, and be configured to fail or deform and permit rotational and lateral movement of the ridge if the threshold force is exceeded. The restraining mechanism can be tabs extending from the attachment panel, fasteners, welds, or another suitable mechanism for resisting lateral movement of the ridge. In the event of a fall, the deformation of the restraining mechanisms and resulting deformation of the module absorb at least some of the fall energy to prevent or mitigate damage to the working structure. The structural sheet and other components of the module are also capable of deforming to absorb the fall energy in order to further prevent or mitigate damage to the working structure. Should the structural sheet and other components of the module be undamaged after a fall, in embodiments, the restraining mechanisms can be replaced or repaired such that the module can be reused.

In a broad aspect, a fall protection module for use on a structure is provided, comprising: a ridge with two lengthwise sides, at least one of the lengthwise sides having a respective attachment panel extending laterally therefrom, the attachment panel being attachable to the structure; one or more user attachment points secured to the ridge; and one or more restraining mechanisms configured to restrain at least lateral and rotational movement of the ridge up to a threshold force and to deform after the threshold force is exceeded.

In an embodiment, the fall protection module further comprises one or more stiffeners connected to the ridge and extending laterally therefrom.

In an embodiment, the one or more restraining mechanisms are one or more tabs extending from each attachment panel and configured to engage a respective stiffener of the one or more stiffeners to restrain at least lateral movement of the ridge.

In an embodiment, the one or more restraining mechanisms are one or more fasteners securing each attachment panel to a respective stiffener of the one or more stiffeners, wherein the fasteners are configured to fail when the threshold force is exceeded.

In an embodiment, the fasteners comprise one of a shear screw, shear pin, rivet, or a combination thereof.

In an embodiment, the one or more restraining mechanisms are welds between each attachment panel and a respective stiffener of the one or more stiffeners, wherein the welds are configured to fail when the threshold force is exceeded.

In an embodiment, the one or more stiffeners are further configured to deform when a second force greater than the threshold force is exceeded.

In an embodiment, the threshold force is less than a pre-determined force and greater than a hanging force and a load testing force.

In an embodiment, the one or more user attachment points comprise one of:

(i) an anchorage connector attached to the ridge;
(ii) a rail extending through at least one rail clamp attached to the ridge;
(iii) a slider supported on the rail and slidably movable therealong; and
(iv) a cable secured to at least one cable connector attached to the ridge;

or a combination thereof.

In an embodiment, the fall protection module further comprises one or more flashings attached to the ridge and extending laterally therefrom.

In another broad aspect, a method for assembling a fall protection module is provided, the method comprising: providing one or more attachment panels connected to a respective lengthwise side of a ridge; securing one or more user attachment points to the ridge; restraining the ridge against at least lateral and rotational movement with a restraining mechanism; wherein the restraining mechanism is configured to permit lateral and rotational movement of the ridge after a threshold force is exceeded.

In an embodiment, the ridge and the one or more attachment panels are formed from a single structural sheet.

In an embodiment, the step of restraining the ridge further comprises securing one or more stiffeners connected to a respective lengthwise side of the ridge to a corresponding attachment panel of the one or more attachment panels.

In an embodiment, the restraining mechanism comprises one or more tabs extending from each of the attachment panels; the step of restraining the ridge further comprises bending the tabs to engage a corresponding stiffener of the one or more stiffeners; and the one or more tabs are configured to deform when the threshold force is exceeded.

In an embodiment, the step of restraining the ridge comprises securing the one or more stiffeners to a respective attachment panel of the one or more attachment panels with one or more fasteners, the fasteners configured to fail when the threshold force is exceeded.

In an embodiment, the fasteners comprise one of shear screws, shear pins, rivets, or a combination thereof.

In an embodiment, the step of restraining the ridge comprises welding the one or more stiffeners to a respective attachment panel of the one or more attachment panels.

In an embodiment, the one or more user attachment points comprise one of:

(i) an anchorage connector attached to the ridge;
(ii) a rail extending through at least one rail clamp attached to the ridge;
(iii) a slider supported on the rail and slidably movable therealong; and
(iv) a cable secured to least one cable connector attached to the ridge;

or a combination thereof; and the step of securing one or more user attachment points to the ridge further comprises replacing one of the one or more user attachment points with another type of user attachment point.

In another broad aspect, a fall protection system for use on a structure to support one or more users is provided, comprising: two or more fall protection modules each comprising: a ridge with two lengthwise sides, at least one of the lengthwise sides having a respective attachment panel extending laterally therefrom, the attachment panel being attachable to the structure; one or more user attachment points secured to the ridge; and one or more restraining mechanisms configured to restrain at least lateral and rotational movement of the ridge up to a threshold force and to deform after the threshold force is exceeded.

In an embodiment, the user attachment points of the fall protection modules cooperate to support the one or more users.

In an embodiment, the fall protection system further comprises one or more stiffeners connected to the ridge of each of the fall protection modules, wherein the one or more restraining mechanisms are one or more tabs extending from each attachment panel of each of the fall protection modules and configured to engage a respective stiffener of the one or more stiffeners to restrain at least lateral movement of the ridge.

In an embodiment, the fall protection system further comprises one or more stiffeners connected to the ridge of each of the fall protection modules, wherein the one or more restraining mechanisms are one or more fasteners securing the attachment panels of each of the fall protection modules to a respective stiffener, wherein the fasteners are configured to fail when the threshold force is exceeded.

In an embodiment, the one or more user attachment points comprise one of:

(i) an anchorage connector attached to the ridge;

(ii) a rail extending through at least one rail clamp attached to the ridge;

(iii) a slider supported on the rail and slidably movable therealong; and (iv) a cable secured to at least one cable connector attached to the ridge;

or a combination thereof.

In an embodiment, each of the fall protection modules further comprise one or more flashings attached to the ridge and extending laterally therefrom.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

DETAILED DESCRIPTION OF THE INVENTION

Figure 1A:
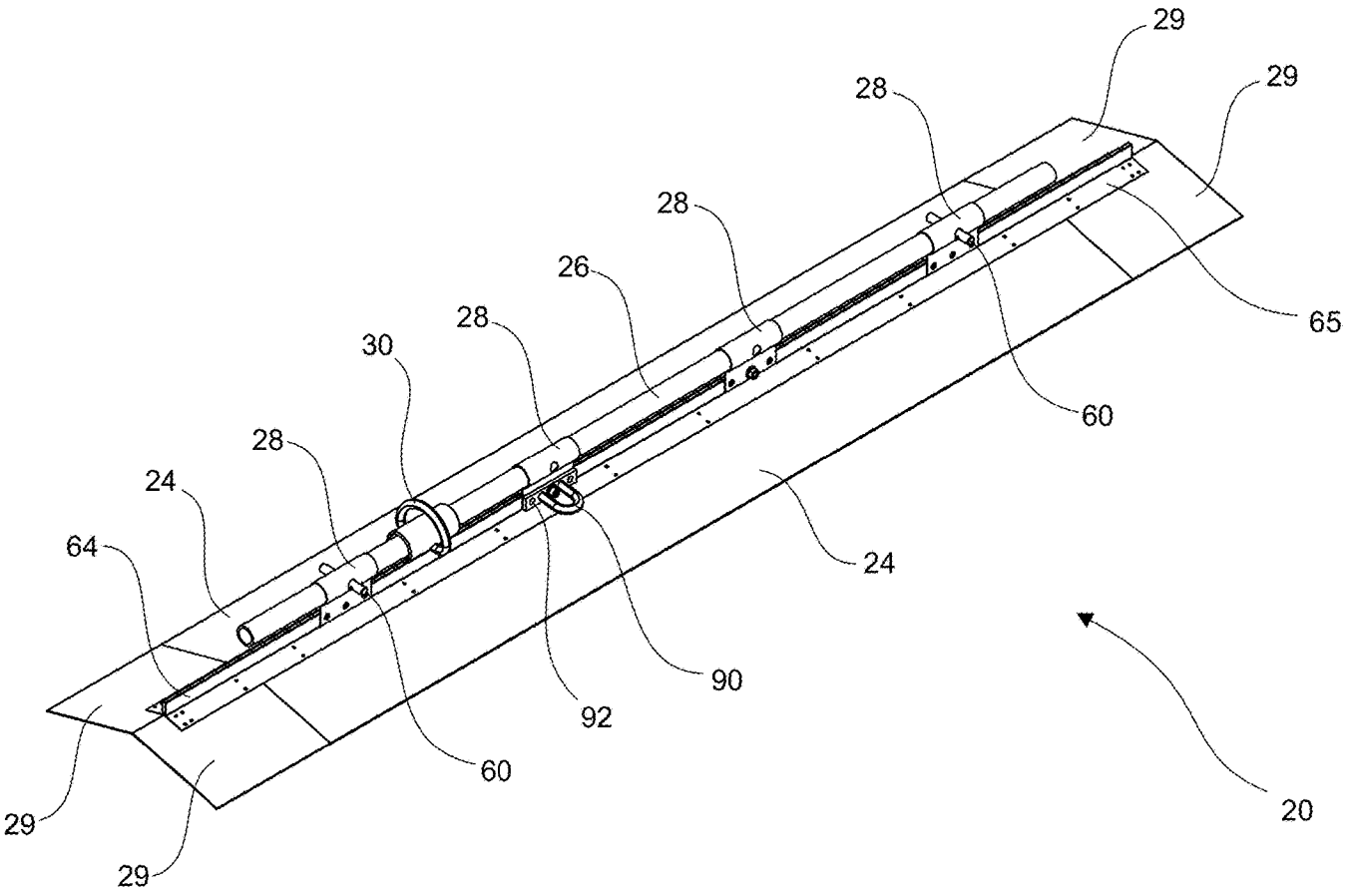
FIG. 1A is a top perspective view of a module of the fall protection system, according to one embodiment of the present disclosure.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

A fall protection system 10 is provided and described herein with reference to FIGS. 1A to 19B. The fall protection system 10, according to some embodiments, comprises one or more modules 20. A sample module 20 of the fall protection system is shown in FIGS. 1A, and 2 to 4. The module 20 is also shown in FIGS. 1B to 1E and 5 to 9, with some parts omitted. According to some embodiments, the module 20 comprises a structural sheet 22 (best shown in FIGS. 1B to 1D, and 4) comprising at least a ridge 54. Attachment panels 50 for securing the module 20 to a working structure can be formed integrally with the ridge 54 as part of the structural sheet 22, or connected to the ridge 54 such as via fasteners or a forming process. The module 20 further comprises a user attachment mechanism 88 to permit a user to be secured to the module 20. The user attachment mechanism 88 can be directly connected to the ridge 54, such as an anchor connector 90, or attached to an intermediate structure 89. For example, as described in further detail below, the user attachment mechanism 88 can be a rail 26 secured to one or more rail clamps 28 of the module 20, a slider 30 connected to the rail 26, or a cable 101 secured to end cable connectors 100 and/or intermediate cable connectors 110. In such cases, the rail clamps 28 and cable connectors 100,110 act as intermediate structures 89. The user is typically secured to the user attachment mechanism 88 via a safety line. As described in further detail below, one or more restraining mechanisms 36 can be used to resist at least rotational and lateral movement of the ridge 54 and/or deformation of the structural sheet 22 due to forces applied to the attachment mechanism 88 until a threshold force is met or exceeded. The restraining mechanisms 36 can be one or more tabs, fasteners, welds, support members, or another suitable mechanism. The module 20 can also optionally comprise one or more flashings 24 to protect components of the module 20 and working structure from environmental elements such as precipitation.

In embodiments, the user attachment mechanism 88 can comprise rail clamps 28 secured to the ridge 54 supporting a rail 26 and optionally one or more sliders 30 slidably mounted on the rail 26 (hereinafter, the "rail version"). In alternative embodiments, the user attachment mechanism 88 can comprise one or more anchorage connectors 90 (hereinafter, the "anchor version"). In further alternative embodiments, the user attachment mechanism 88 can comprise two or more cable connectors 100,110 having a cable 101 extending therebetween (hereinafter, the "cable version"). Other embodiments are also possible wherein other user attachment mechanisms 88 are used to permit a person to secure herself to the module 20 and anchor system. In some embodiments, the module user attachment mechanism 88 is a combination of one or more of the rail version, the anchor version, the cable version, and another suitable user attachment mechanism 88.

In the rail version, a person is attached to the rail 26 or the slider 30 using a safety line. In case of a fall, a force is exerted on the structural sheet 22 via the slider 30, the rail 26, and the rail clamps 28 and the resulting stress on the structural sheet 22 causes the restraining mechanism 36, structural sheet 22, stiffener 23 and rail clamps 28 to deform, thereby absorbing at least some of the energy of the fall and thus reducing the risk of injury to the person. As will be explained in more detail below, the rail version provides continuous coverage of an area such that the person can freely and safely move around in the area.

In the anchor version, the person is attached to the anchorage connector 90 via a safety line, harness (including, for example, a boatswain's chair, which allows the person to suspend in mid-air at the location of the anchorage connector 90 from the ends of the module 20 and from the side of the module 20 on which the anchorage connector 90 is mounted). The anchor version additionally provides travel restraint and fall arrest for the person at a discrete location in both axial directions of the ridge 54 and from the side of the module 20 on which the anchorage connector 90 is mounted. In the event of a fall, a force is exerted on the structural sheet 22 via the anchorage connector 90, and causes the restraining mechanism 36, structural sheet 22, stiffener 23 to deform, thereby absorbing at least some of the energy of the fall.

In the cable version, the person is attached to a cable 101 spanning the two or more cable connectors 100,110. As with the rail version, the cable version provides continuous coverage of an area between the cable connectors 100,110. In the event of a fall, a force is exerted on the structural sheet 22 via the cable 101 and cable connectors 100,110, and causes the restraining mechanism 36, structural sheet 22, stiffener 23 and cable connectors 100,110 to deform, thereby absorbing at least some of the energy of the fall.

The fall protection system 10 described herein is designed to have the ability and flexibility to incorporate one or a combination of the anchor version, rail version, cable version, or any other suitable attachment mechanism 88. Therefore, the fall protection system may be configured to provide one or all of: (i) fall arrest and suspension at a discrete location in the anchor version; (ii) continuous fall protection coverage in the rail or cable versions; and (iii) other suitable attachment mechanisms.

The present disclosure aims to provide a relatively low-profile, unobtrusive fall protection system 10 that: (i) may considerably reduce the installation times on varying structures including but not limited to newly built roofs and on existing roofs; (ii) may be applied to roofs of various types and age; (iii) may offer a greater assurance of waterproofing of the roof; (iv) may provide greater assurances of reliability and safety in use; (v) can be manufactured easily using commonly commercially available elements and materials and is furthermore competitive from an economic standpoint; (vi) selectively allows in-air suspension or fall arrest at a discrete location or continuous coverage via a slider/rail arrangement from the same module connected to the building structure; and (vii) mitigates damage to the structure onto which it is installed in the event of a fall.

With reference to FIGS. 1B to 1D and 5 to 9, in an embodiment, the structural sheet 22 of module 20 is a sheet of material such as steel for attachment to a building structure, for example at the trusses of the building structure such as the principal rafters and/or common rafters of a roof structure. The structural sheet 22 may also be attached to the roof sheathing, roof panels, or other attachments directly or indirectly to the underlying structure. Structural sheet 22 has two attachment panels 50 separated lengthwise by an axially extending ridge 54. In other words, each attachment panel 50 extends laterally from the ridge 54. The two attachment panels 50 may or may not have the same dimensions. In some embodiments, each attachment panel 50 has a plurality of attachment locations 33 intermittently positioned and spaced apart along its length. Each attachment location 33 has one or more attachment apertures 34, at least one of which may receive a fastener therethrough such as a screw, bolt, and the like. For simplicity, fasteners are not shown in the figures. The attachment panels 50 can be formed integrally with the ridge 54 or connected thereto using suitable means such as fasteners, welding, adhesives, and the like.

The ridge 54 has a plurality of attachment sections 55 intermittently positioned and spaced apart along its length. Each attachment section 55 has one or more apertures 56 for receiving a fastener therethrough. The ridge 54 can directly support flashing ridge 64, one or more intermediate support structures 89 such as rail clamps 28, end cable connectors 100, intermediate cable connectors 110, and the like, and/or the one or more user attachment mechanisms 88 such as an anchorage connector 90. The intermediate structures 89 can be used to support certain types of user attachment mechanisms 88. For example, the user attachment mechanism 88 can be a rail 26 supported on rail clamps 28, or a cable 101 secured to cable connectors 100,110. As described in further detail below, the user attachment mechanism 88 can also be a slider 30 slidably retained on the rail 26.

Figure 8:
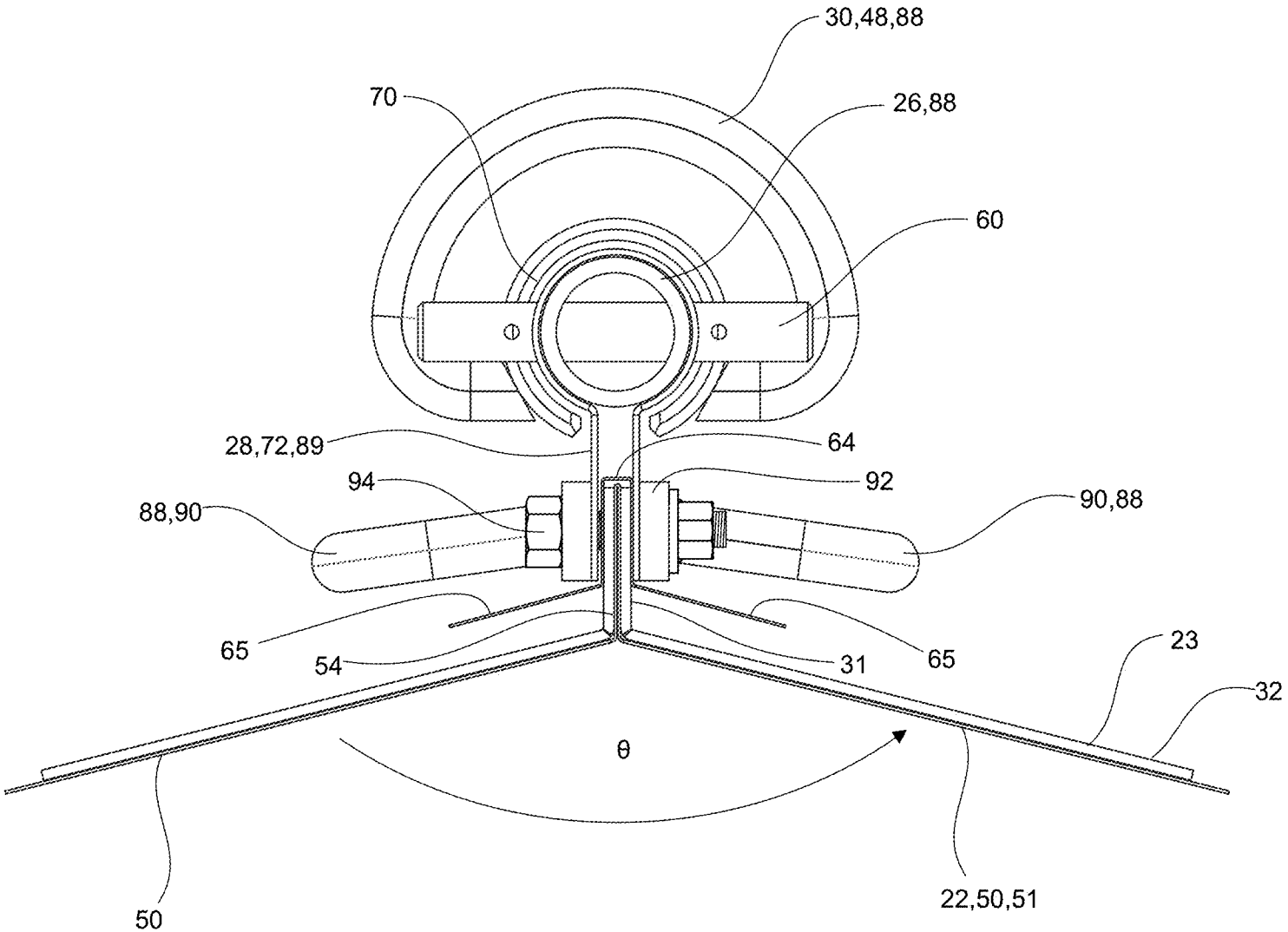
FIG. 8 is an end view of the module of FIG. 5; shown without flashings
Figure 9:
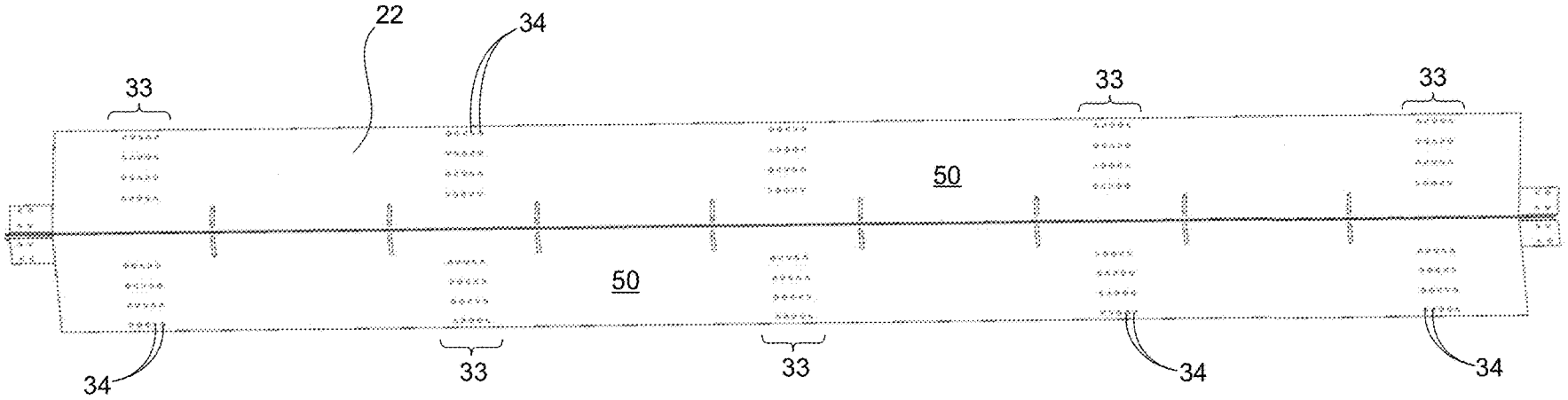
FIG. 9 is a bottom plan view of the module of FIG. 5; shown without flashings

In the illustrated embodiment, as best shown in FIG. 8, an angle θ is defined between the inner faces 51 of the attachment panels 50. The inner face 51 is the face that is adjacent to the building structure when the structural sheet 22 is attached to the building structure. The angle θ may range from about 0° to about 180° depending on the shape of the building structure to which structural sheet 22 is to be attached (e.g. the pitch of a roof). In still other embodiments, the angle θ may be greater than 180°. Angle θ may also vary between different structural sheets.

Figure 1B:
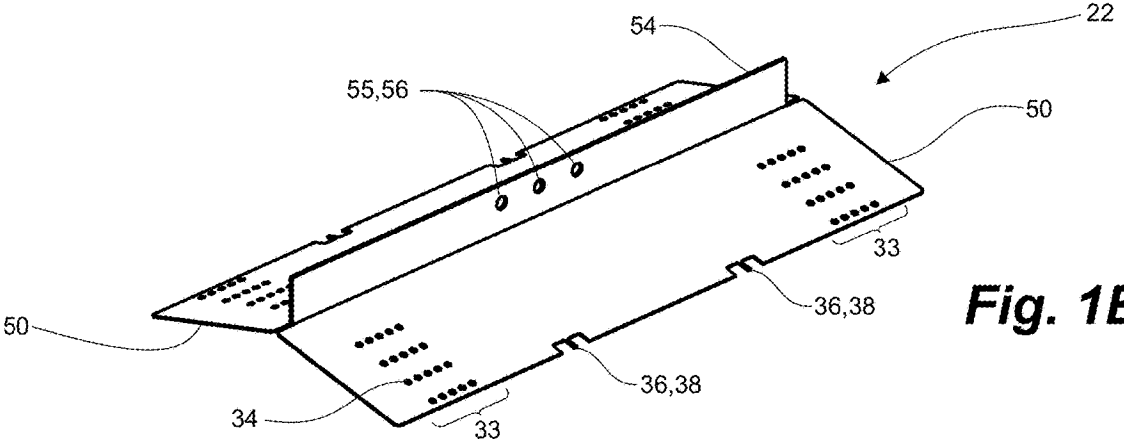
FIG. 1B is a perspective view of a structural sheet of an embodiment of a module of the fall protection system having restraining tabs.
Figure 1D:
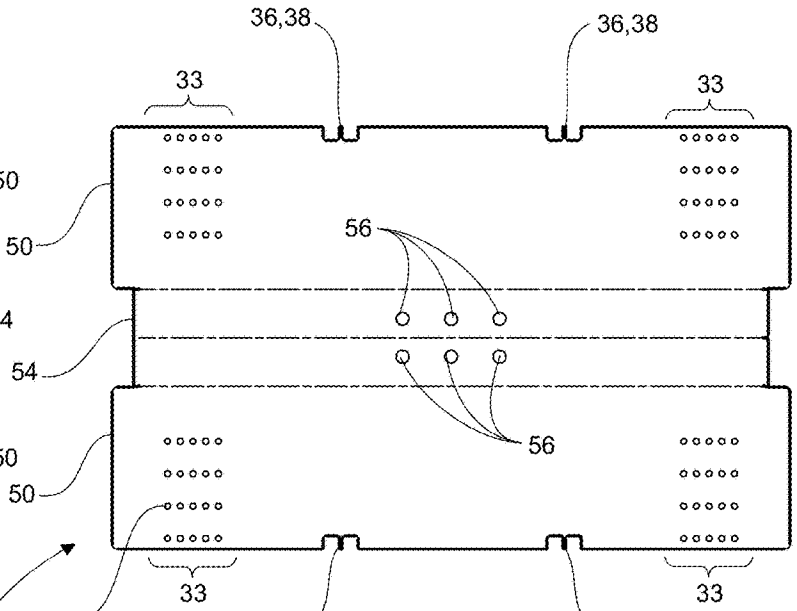
FIG. 1D is a top view of the structural sheet of FIG. 1B in an unfolded configuration.
Figure 1C:
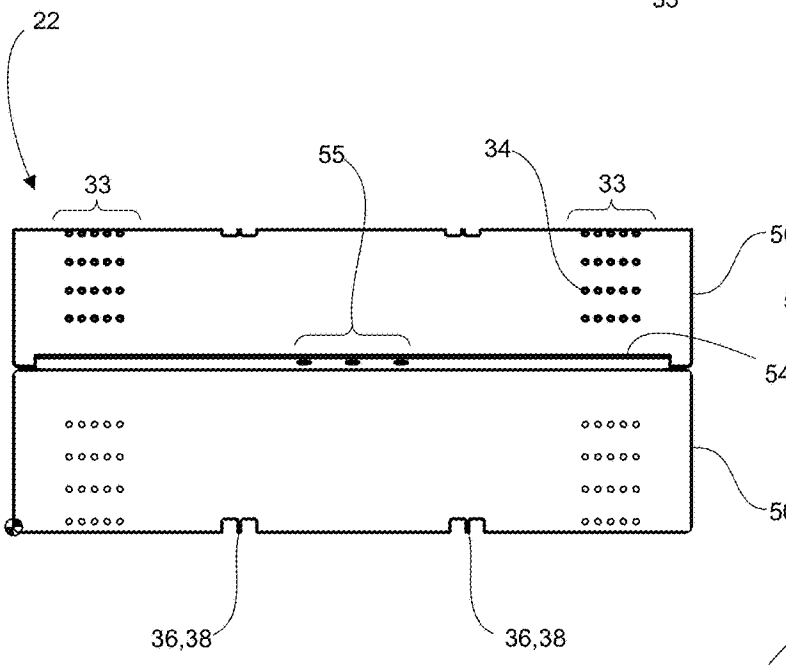
FIG. 1C is a top view of the structural sheet of FIG. 1B.

In some embodiments, with reference to FIGS. 1B to 1D, the structural sheet 22 is formed by folding and bending a single sheet of material. For example, a sheet of metal may be folded in half at a first or central fold line and bent lengthwise laterally at a distance from the first fold line to form the ridge 54 along the first fold line, and the attachment panels 50 on each lengthwise side of the ridge 54. While the illustrated embodiment shows two attachment panels 50, structural sheet 22 may only have one attachment panel 50 in other embodiments. In other embodiments, the attachment panels 50 can be discrete members secured to the ridge 54 rather than being integral therewith. Herein, the term "structural sheet" 22 is used to refer to the ridge 54 and attachment panels 50, wherein the ridge 54 and attachment panels 50 are formed integrally or are connected to attachment panels 50 via suitable means such as fasteners, welding, adhesives, forming techniques and the like.

While structural sheet 22 is shown in the illustrated embodiment as a piece of material that is substantially continuous axially, in some embodiments there may be gaps in the structural sheet 22 and/or in one or both of the attachment panels 50 to provide direct access to the building structure. Further, while structural sheet 22 is shown to have substantially rectangular panels 50, it can be appreciated that panels 50 may be of other shapes. Still further, ridge 54 and/or attachment panels 50 may be of any length. Furthermore, the positions of attachment locations 33 and/or the attachment sections of ridge 54 may be varied to accommodate different underlying structures and/or the intended fall protection function of the system. In some embodiments, the structural sheet 22 is made of stainless steel, steel, aluminum, or any other suitable material as known to those skilled in the art.

In embodiments, with reference to FIGS. 4 to 8, the module 20 may have one or more stiffeners 23 to enhance the structural integrity and strength of the structural sheet 22. The stiffener 23 may be attached to the ridge 54 at one of the attachment sections 55 thereof. In some embodiments, the stiffener 23 has a stiffener ridge 31 and a stiffener panel 32 extending laterally from the stiffener ridge. The stiffener ridge 31 has one or more stiffener apertures for alignment with the one or more attachment apertures 56 in one of the attachment sections 55 of the ridge 54. The stiffener 23 can thus be attached to the ridge 54 by aligning the one or more stiffener apertures 35 of the stiffener ridge 31 and the apertures 56 of the ridge 54, and installing fasteners through the aligned apertures 35,56. In embodiments, the stiffener panel 32 is configured to lie flat against the surface of the corresponding attachment panel 50 when the stiffener ridge 31 is secured to the ridge 54. Stiffener 23 may be made of stainless steel, steel, aluminum, or any other suitable material as known to those skilled in the art.

In embodiments, with reference to FIGS. 1B to 1F and 15A to 18, the module 20 comprises one or more restraining mechanisms 36 for resisting at least rotational and lateral movement and/or deformation of the ridge 54 and structural sheet 22 due to a force applied to the module 20, for example by a user attached to the user attachment mechanism 88, up to a threshold force. The restraining mechanisms 36 can be configured to fail or deform once the threshold force has been met or exceeded to absorb some of the force applied to the module 20, and permit the ridge 54 and structural sheet 22 to deform to further absorb the force applied to the module 20. In embodiments, the cumulative threshold force of the restraining mechanisms 36 can be selected such that it is less than a pre-determined force, such as a falling force of a user, and less than the force required to deform the structural sheet 22, but greater than any required proof testing force and greater than the expected hanging force of a user hanging from the module 20, such as from a boatswain's chair. In this manner, the restraining mechanisms 36 do not permit lateral movement or deformation of the ridge 54 and structural sheet 22 during normal use and, in the event of a fall, mitigate damage to the structural sheet 22 and working structure by absorbing some of the falling force from the user. If the structural sheet 22 is undamaged after a fall, the failed or deformed restraining mechanisms 36 may be replaced such that the module 20 can continue to be used instead of having to be replaced. For example, in a test case, plastic deformation in module 20 and restraining mechanism 36 typically occurs between 13.34-17.1 kN (3000-3844 lbs.), hence it can be expected that the modules 20 could be re-used if plastic deformation has not occurred.

For example, in an embodiment, with reference to FIGS. 1B to 1F, 15A, and 15B, the attachment panels 50 of the module 20 can have one or more restraining tabs 38 configured to extend therefrom and engage a corresponding stiffener panel 32 to resist lateral movement of the stiffener 23 and the ridge 54 connected thereto. The tabs 38 can be configured to bend or otherwise deform after the threshold force is reached. In embodiments, the tabs 38 can be formed integrally with the attachment panels 50 and bent to be perpendicular or about perpendicular to a plane of their respective panel 50 to engage the corresponding stiffener panel 32. The attachment panels 50 can each have multiple tabs, wherein the number of tabs bent to engage with the stiffeners 23 are selected to provide the desired cumulative threshold force. Further, in the event of a fall, unused tabs 38 can potentially be bent to replace the tabs 38 that were deformed by the falling force.

Figure 16A:
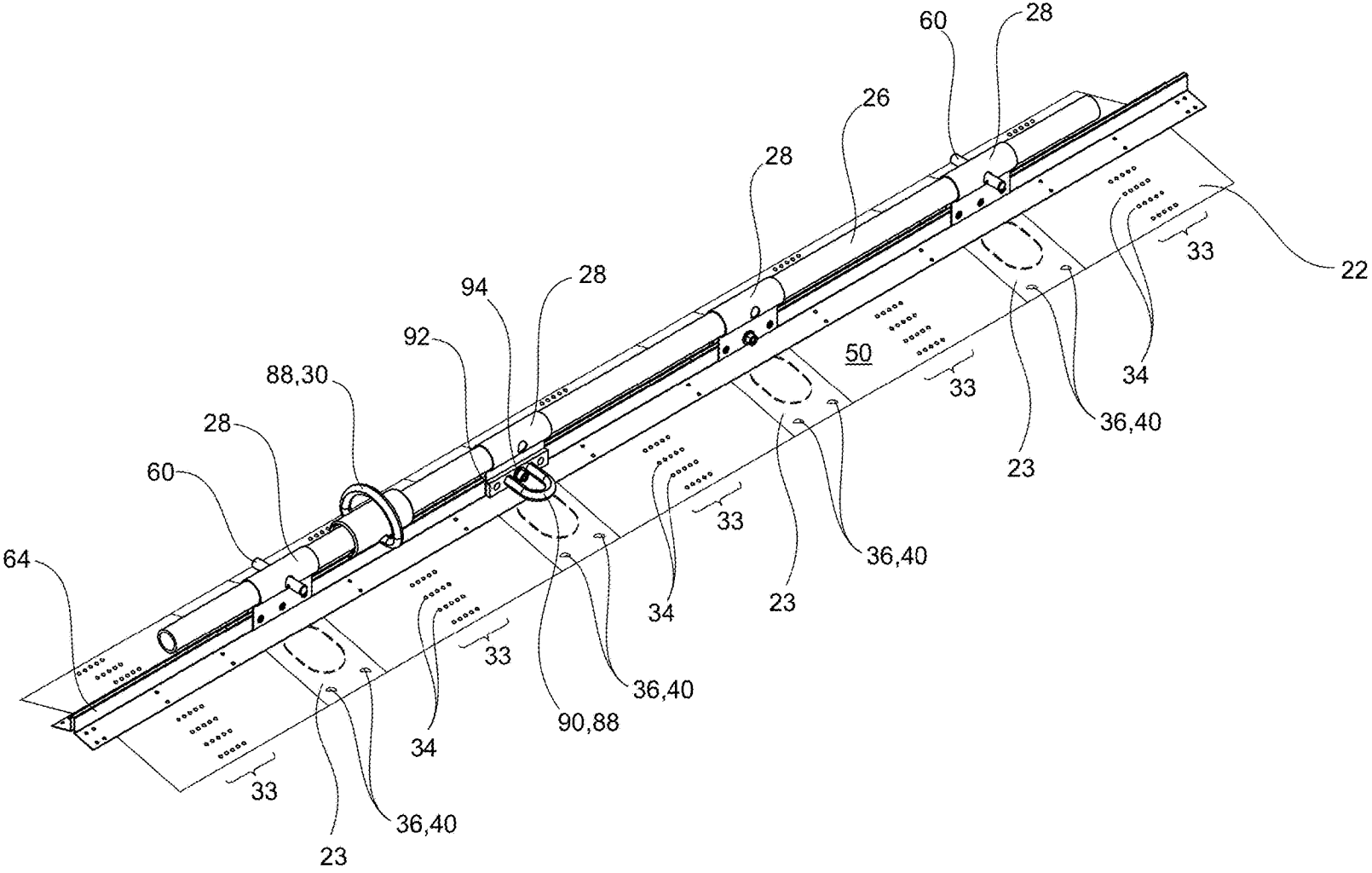
FIG. 16A is a perspective view of a module of the fall protection system, according to one embodiment of the present disclosure wherein restraining fasteners resist lateral movement and deformation of a ridge of the module.
Figure 16B:
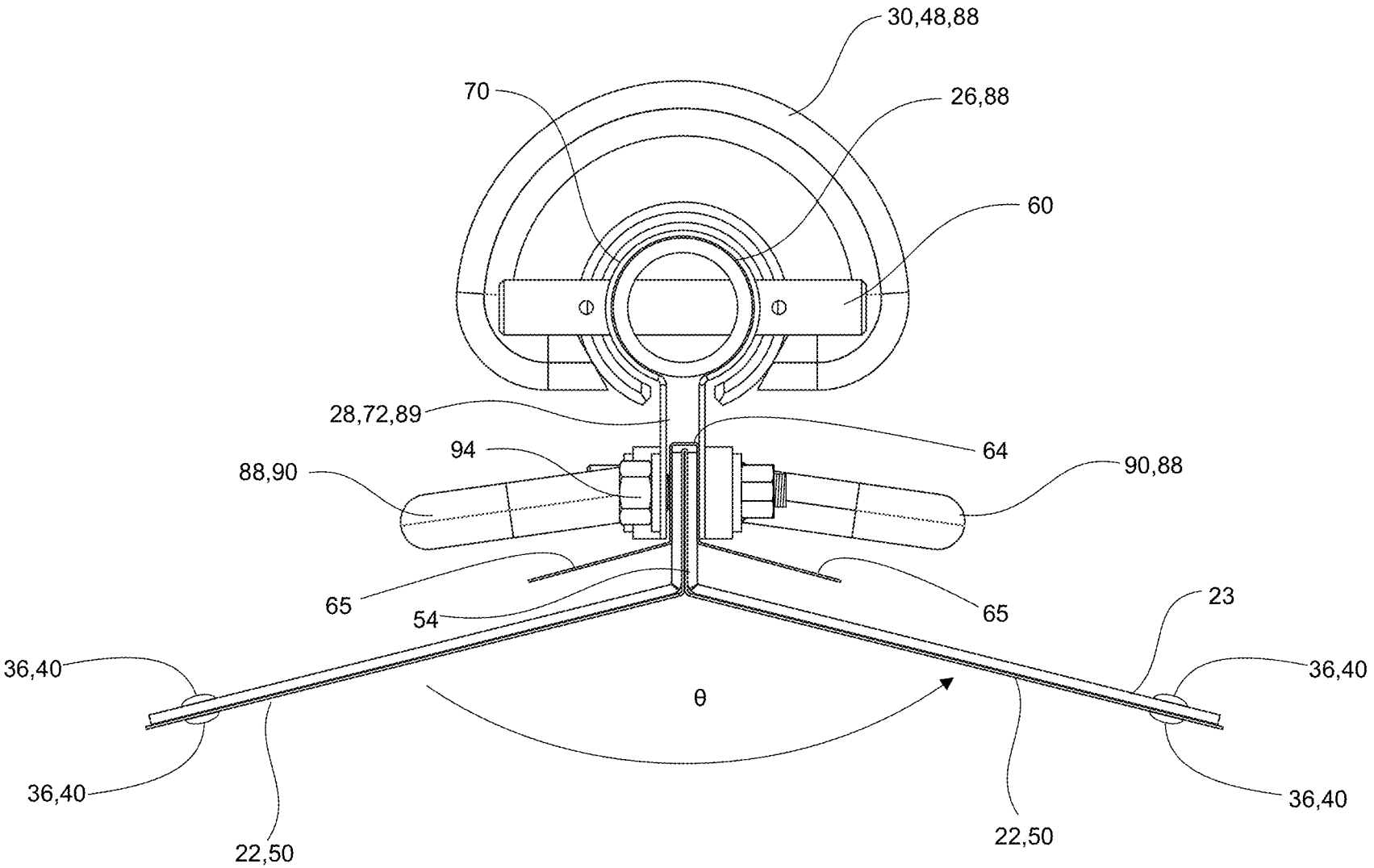
FIG. 16B is an end view of the module of FIG. 16A.

In other embodiments, with reference to FIGS. 16A and 16B, the restraining mechanisms 36 can be fasteners 40 extending through respective restraining apertures of the attachment panels 50 and stiffener panels 32 and securing said panels 50,32 together, thereby resisting lateral movement of the stiffener 23 and ridge 54 connected thereto up to the cumulative threshold force. The fasteners 40 can be configured to shear or otherwise fail once the selected threshold force has been reached. For example, the fasteners 40 can be shear screws or bolts, rivets, pins, or any other suitable fastener for preventing at least rotational and lateral movement of the stiffener 23 relative to the attachment panels 50 up to a predetermined force.

Figure 17:
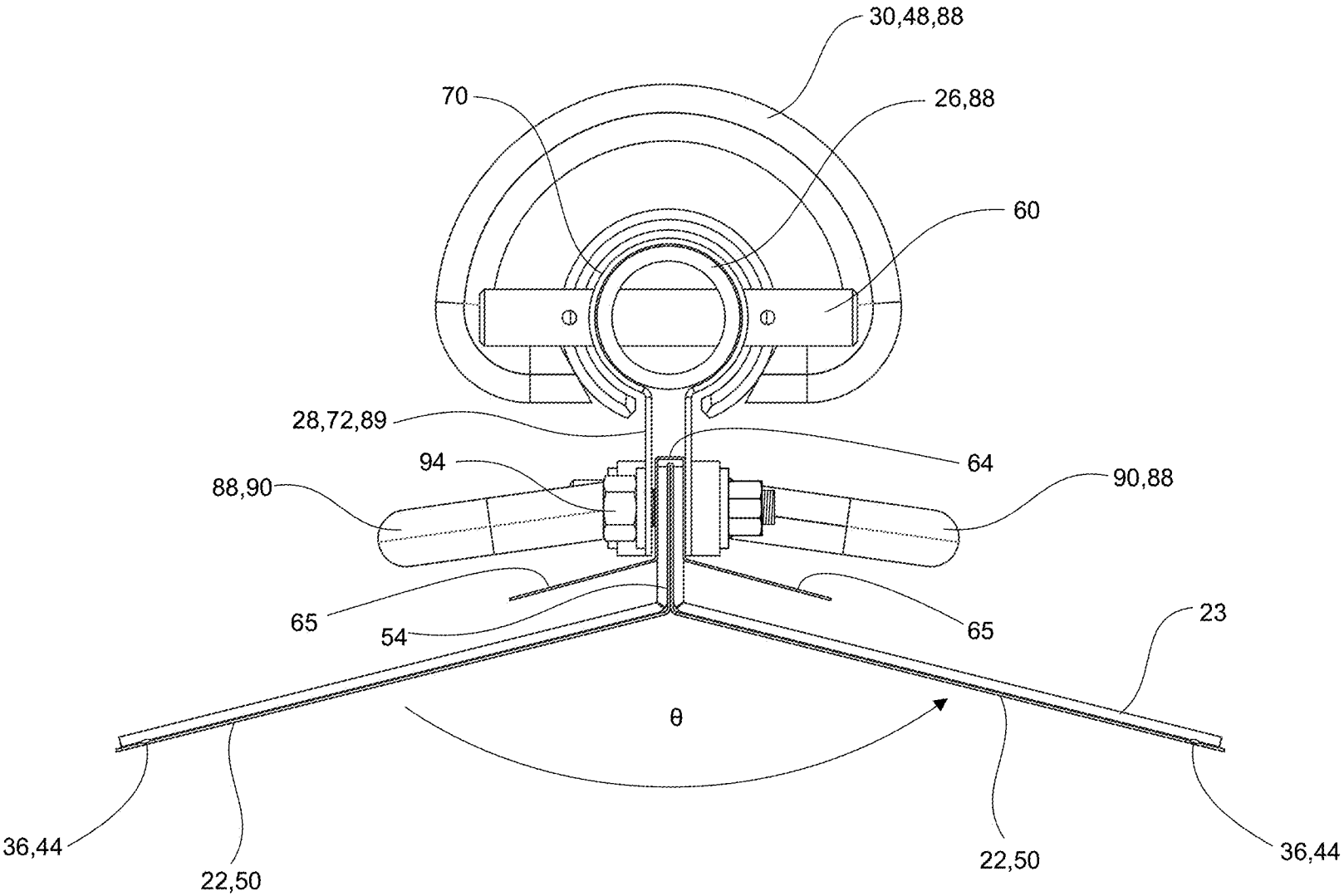
FIG. 17 is an end view of a module of the fall protection system, according to one embodiment of the present disclosure wherein a stiffener of the module is welded to a structural sheet of the module to resist lateral movement and deformation of a ridge of the module.
Figure 18:
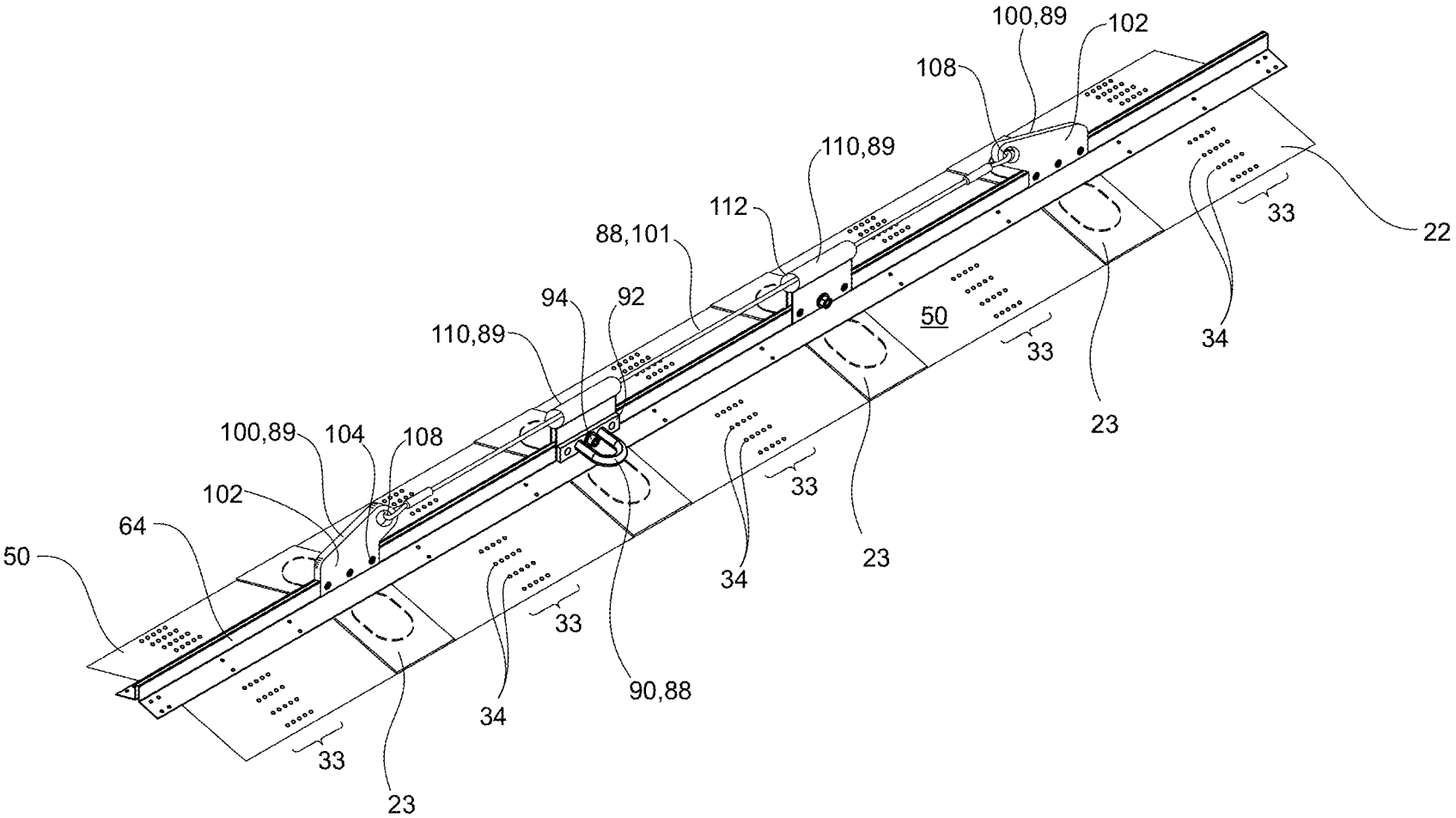
FIG. 18 is a perspective view of a module of the fall protection system, according to one embodiment of the present disclosure, having cable connectors and a cable.

In other embodiments, with reference to FIG. 17, the stiffener panels 32 can be welded to the attachment panels 50 instead of being secured thereto with fasteners 40, the welds 44 configured to fail if the threshold force is reached or exceeded.

In the embodiments described above, the restraining mechanisms 36 directly or indirectly connect the attachment panels 50 with a respective side of the ridge 54 to prevent at least rotational and lateral movement of the ridge 54 up to the threshold force.

In some embodiments, with reference to FIGS. 1A to 4, module 20 comprises two flashings 24 connected at a lengthwise side thereof by axially extending flashing ridge 64 such that flashings 24 extend laterally outwardly from the lengthwise sides of the flashing ridge 64. For example, flashings 24 may comprise elongated sheets of material. Together, the flashing ridge 64 and the flashings 24 provide weather-resistant coverage and protection for structural sheet 22 and building envelope (not shown). The flashings 24 may be secured to the flashing ridge 64 by fasteners, adhesives, welding, or other methods known to those in the art. In other embodiments, the flashings 24 and the ridge 64 may be integrated such that they are not separate components. For example, the flashings 24 and ridge 64 may be formed by folding and bending a single sheet of material, such as a sheet of metal that is folded in half and bent lengthwise laterally at a distance from the fold to form a ridge along the fold and a flashing on each side of the ridge.

Figures 1E, 1F:
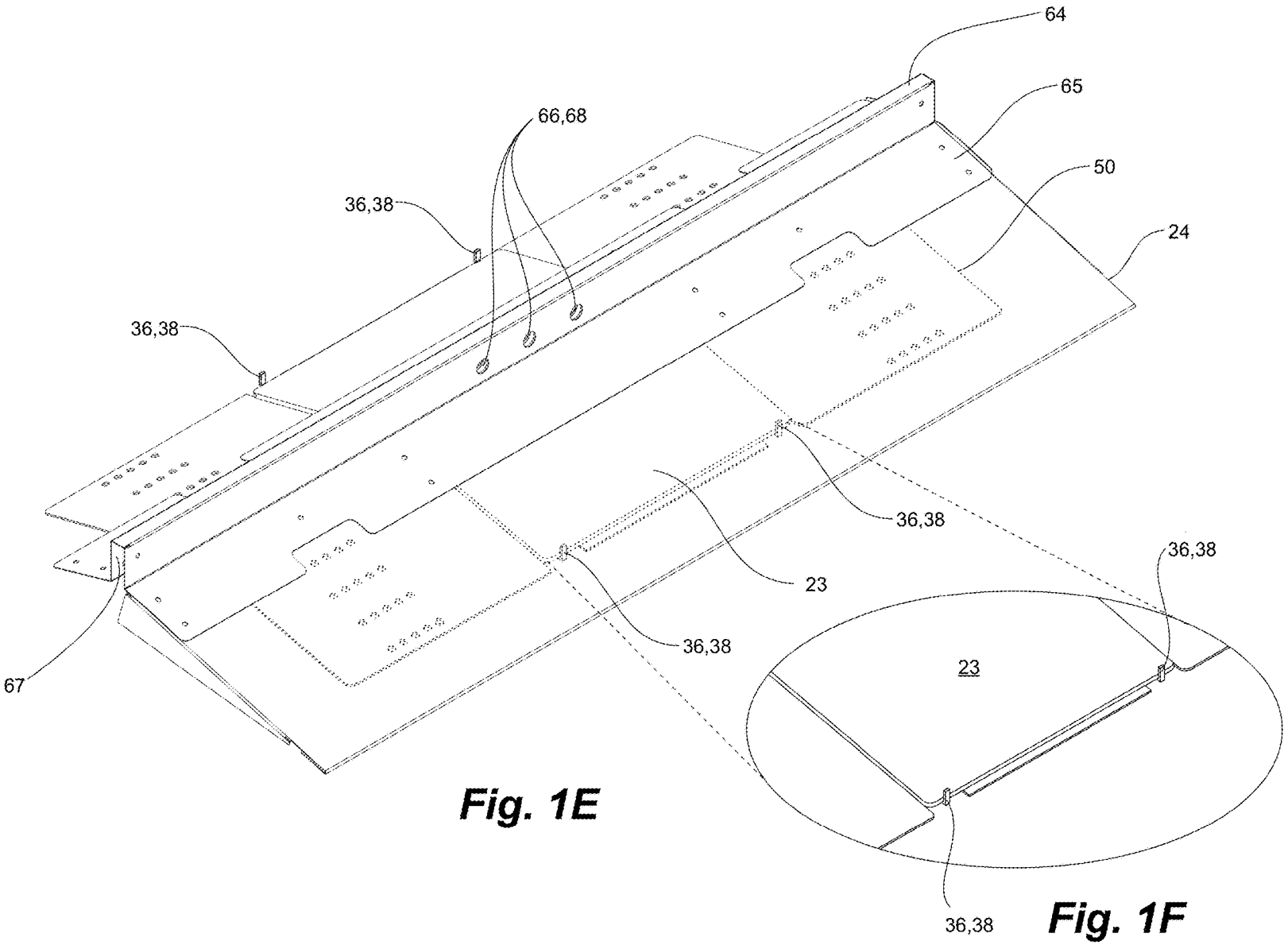
FIG. 1E is a perspective view of a module of the fall protection system having restraining tabs for restraining lateral movement of the ridge and deformation of the structural sheet.
FIG. 1F is an enlarged view of the restraining tabs of the module of FIG. 1E.
Figure 2:
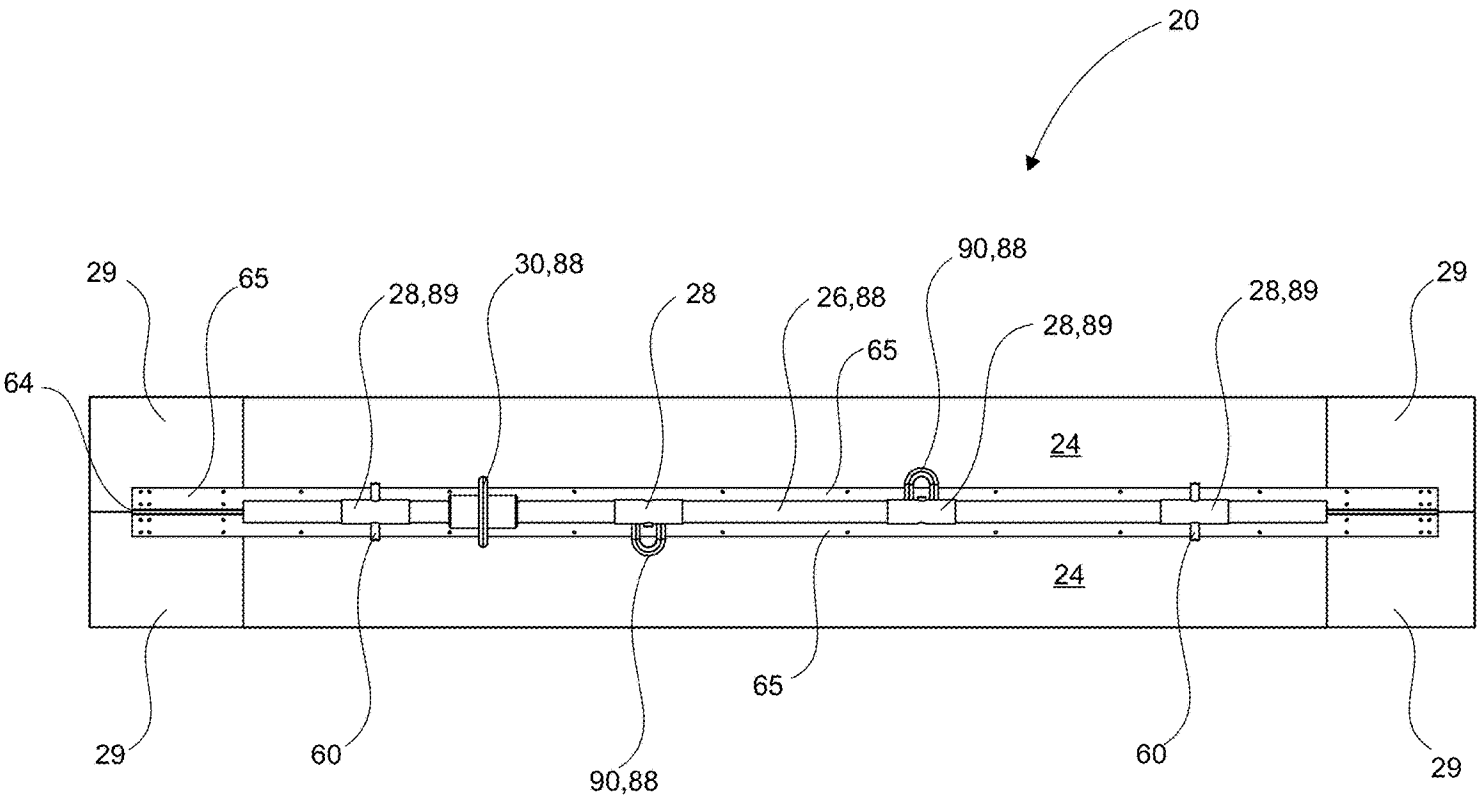
FIG. 2 is a top plan view of the module of FIG. 1.
Figure 3:
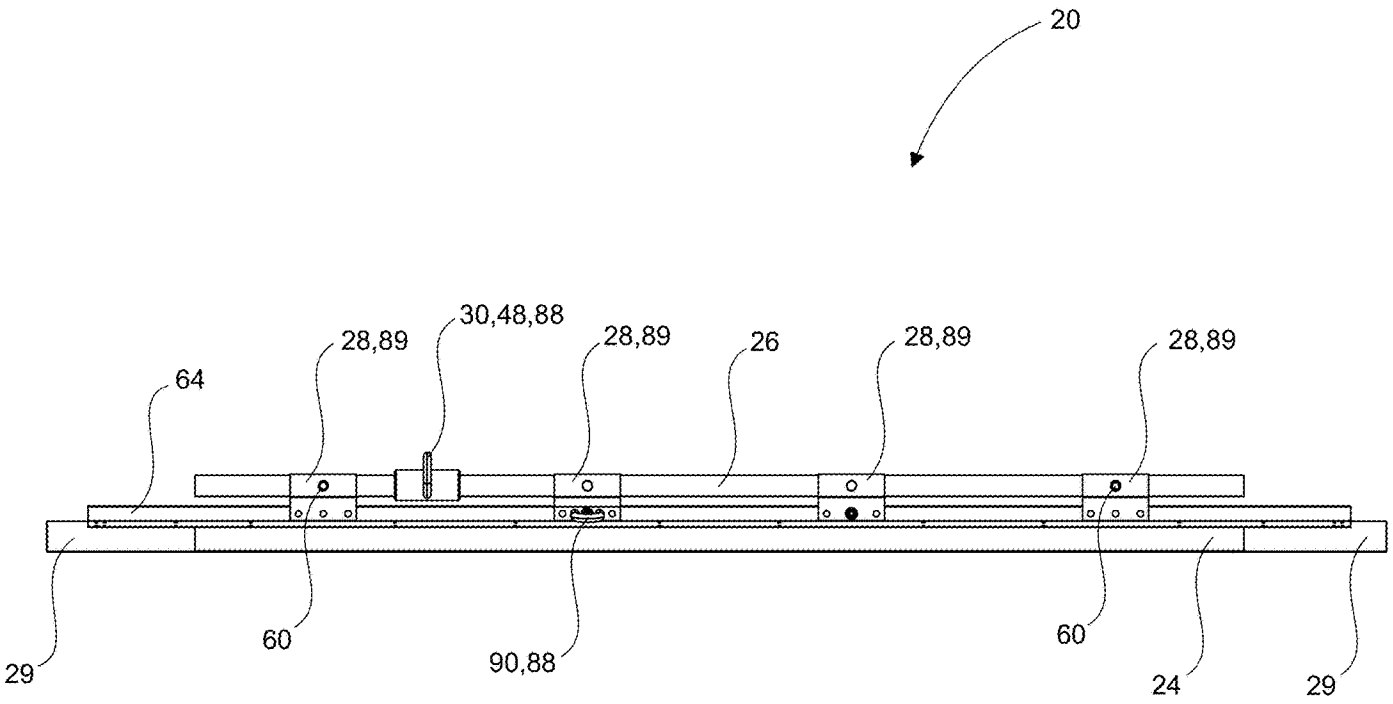
FIG. 3 is a side plan view of the module of FIG. 1.

In the illustrated embodiment in FIG. 1E, the flashing ridge 64 has a laterally extending side flange 65 at each lengthwise side thereof for connecting with a lengthwise side of one of the flashings 24. The flashing ridge 64 has a plurality of attachment sections 66 intermittently positioned and spaced apart along its length. Each attachment section 66 has one or more apertures 68, each for receiving a fastener therethrough. The flashing ridge 64 may be configured such that it can be axially aligned with the ridge 54 of the structural sheet 22. In some embodiments, the flashing ridge 64 has an inner facing channel 67 which is configured for receiving ridge 54 of the structural sheet 22 therein (and the stiffener ridge, if stiffener 23 is included). The one or more apertures 68 are spaced along the flashing ridge 64 to align with the one or more apertures 56 of ridge 54 and the stiffener apertures of the stiffener ridge 31 when ridge 54 and the stiffener ridge are received in the channel 67 of flashing ridge 64, such that a fastener can be received through an aligned array of apertures to thereby secure the structural sheet 22 to the flashing ridge 64. It can be appreciated that the positions of attachment sections 66 of flashing ridge 64 are configured to coincide with the attachment sections 55 of ridge 54, and may be varied to accommodate different building structures.

Figure 5:
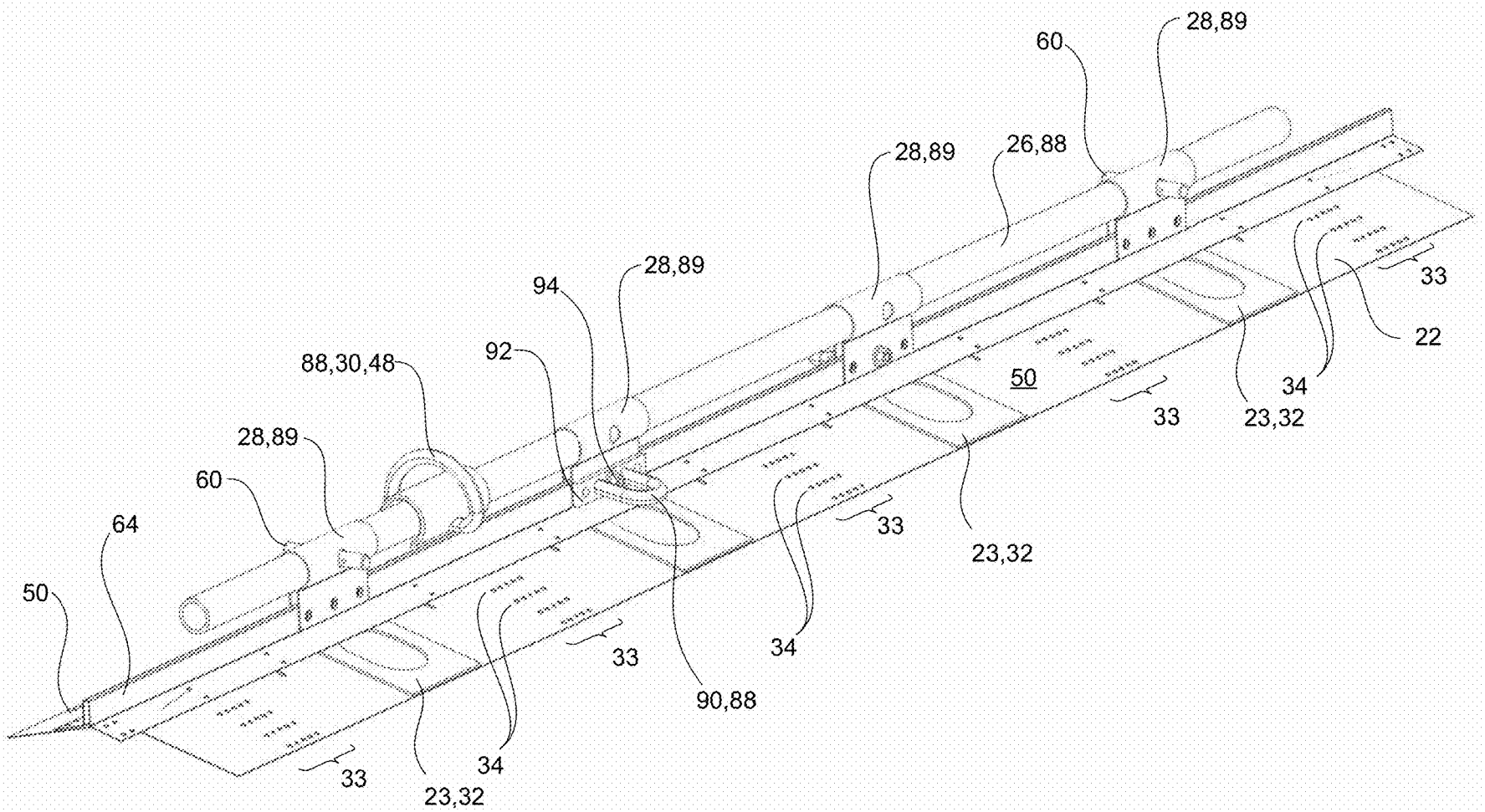
FIG. 5 is a perspective view of the module of FIG. 1, shown without flashings.
Figure 6:
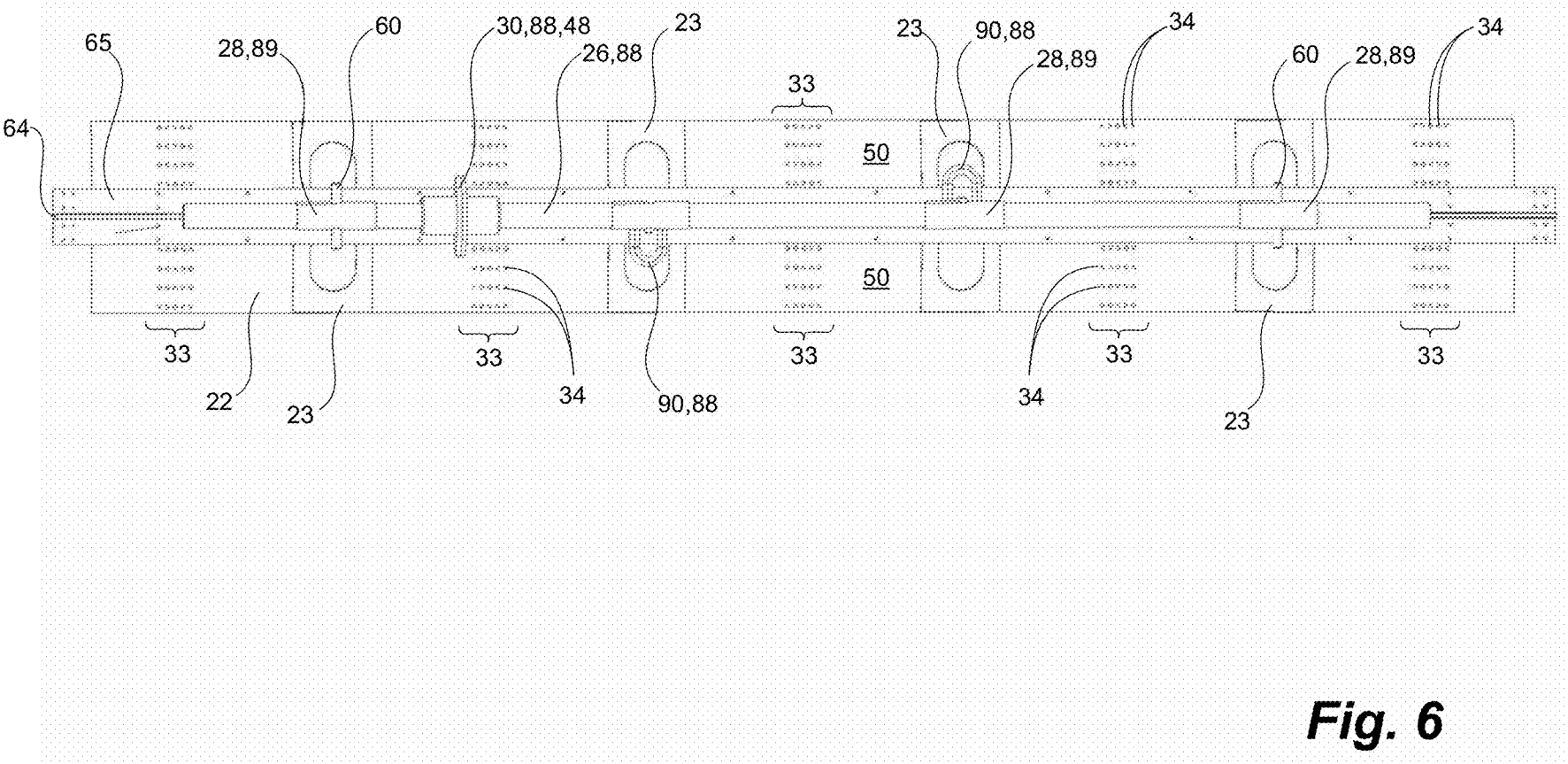
FIG. 6 is a top plan view of the module of FIG. 5; shown without flashings
Figure 7:
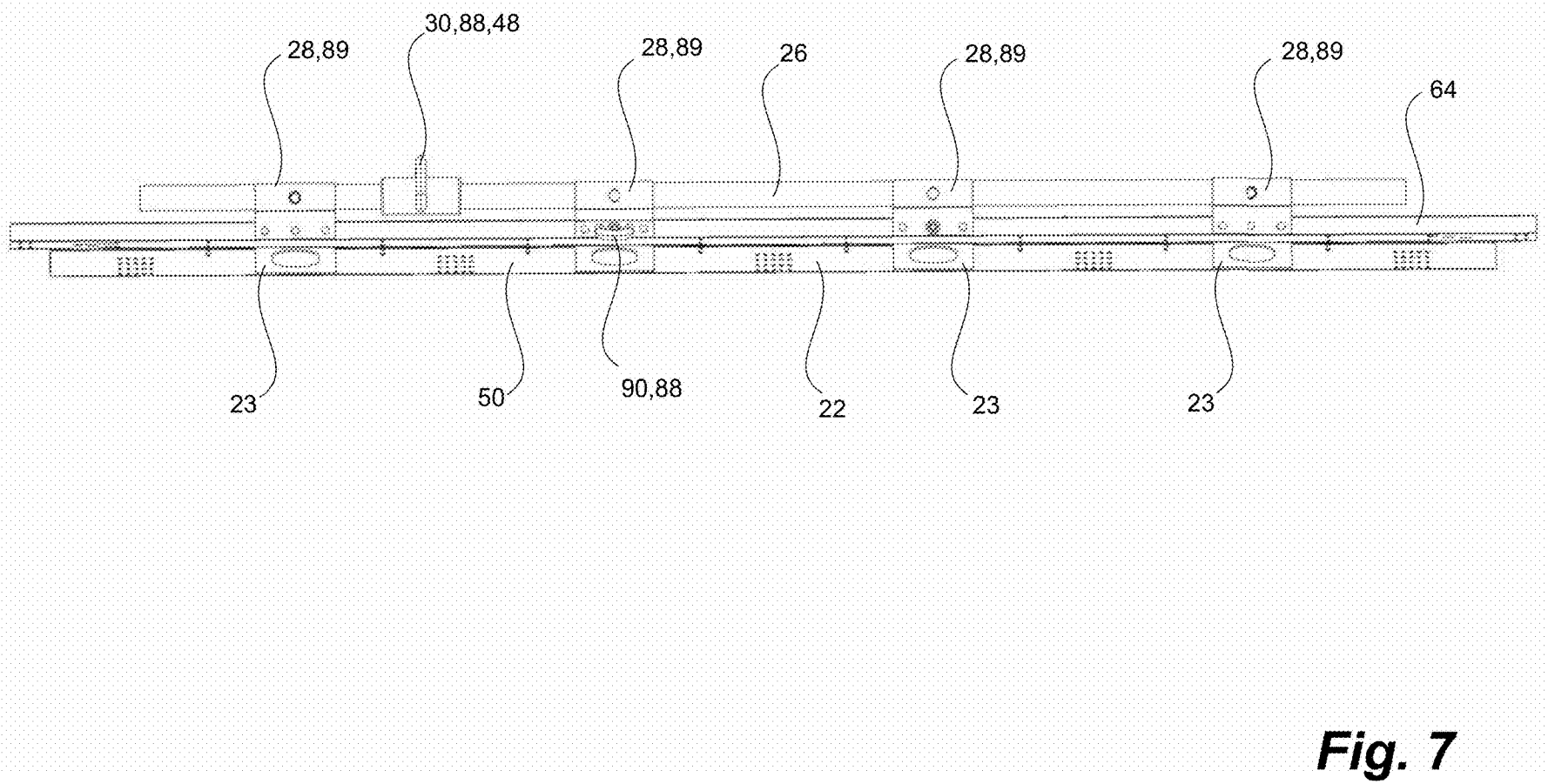
FIG. 7 is a side plan view of the module of FIG. 5; shown without flashings

In some embodiments, as best shown in FIGS. 5 to 7, the length of flashing ridge 64 is greater than the length of the attachment panels 50 such that the ends of ridge 64 extend axially beyond the corresponding ends of the panels 50.

As best shown in FIGS. 1 to 4, the flashings 24 are configured to provide physical coverage for structural sheet 22 to protect structural sheet 22 and the building envelope from water and the elements and to prevent precipitation from entering the apertures 34 and potentially corroding them or the fasteners inserted therethrough. In the illustrated embodiment, when ridge 54 is received in the channel 67 of flashing ridge 64 and when the flashings 24 are attached to the lengthwise sides of flashing ridge 64, flashings 24 substantially cover the outer faces of attachment panels 50 but a gap G is maintained between each flashing 24 and its adjacent attachment panel 50. The size of gap G, i.e. the distance between the inner face of flashing 24 and the outer face of the adjacent attachment panel 50, may vary throughout the surface area of the flashings 24 and attachment panels 50. However, in most embodiments, the size of gap G is greater than 0. To help maintain the gap G between the flashings 24 and attachment panels 50, the distance from the transition of the structural sheet ridge 54 and structural sheet flange/attachment sections 55 to the structural ridge apertures 56 is greater than the distance from the transition of the flashing ridge 64 and flashing flange/attachment sections 66 to the flashing apertures 68. Ridge 64 may be of any length. In some embodiments, the module 20 may include a spacer (not shown) in between each attachment panel 50 and its corresponding flashing 24 to help maintain the gap G.

While flashings 24 are shown to be substantially mirror images of one another, the two flashings 24 may or may not have the same dimensions in other embodiments. In embodiments, the flashings 24 are shaped and sized to cover most or all of the surface of panels 50. The surface area of flashing 24 may be larger or at least the same as that of its corresponding panel 50. In one embodiment, the width and length of the flashing 24 are greater than those of its corresponding attachment panel 50 such that the free side and ends of the flashing 24 extend laterally and axially, respectively, beyond those of the corresponding panel 50 to protect the panel 50. Further, even though each flashing 24 is shown in the illustrated embodiment as a piece of material that is substantially continuous axially, in some embodiments there may be gaps in the flashing 24 depending on the position of the structural sheet 22. Still further, while flashings 24 are shown to be substantially rectangular in shape, it can be appreciated that flashings 24 may be of any length and/or shape as long as they provide substantial coverage for panels 50.

In some embodiments, the flashings 24 and/or the ridge 64 are made of stainless steel, plastic, galvanized steel, painted metal, steel, or a combination thereof. Further, it can be appreciated that where the structural sheet 22 has only one attachment panel 50, only one flashing 24 is necessary to protect that panel 50. In some embodiments, flashings 24 may be omitted if the module 20 is to be used where precipitation or other elements are not a concern; for example, flashings 24 can be omitted if module 20 is to be installed indoors or if the building envelope is otherwise protected.

Figure 10:
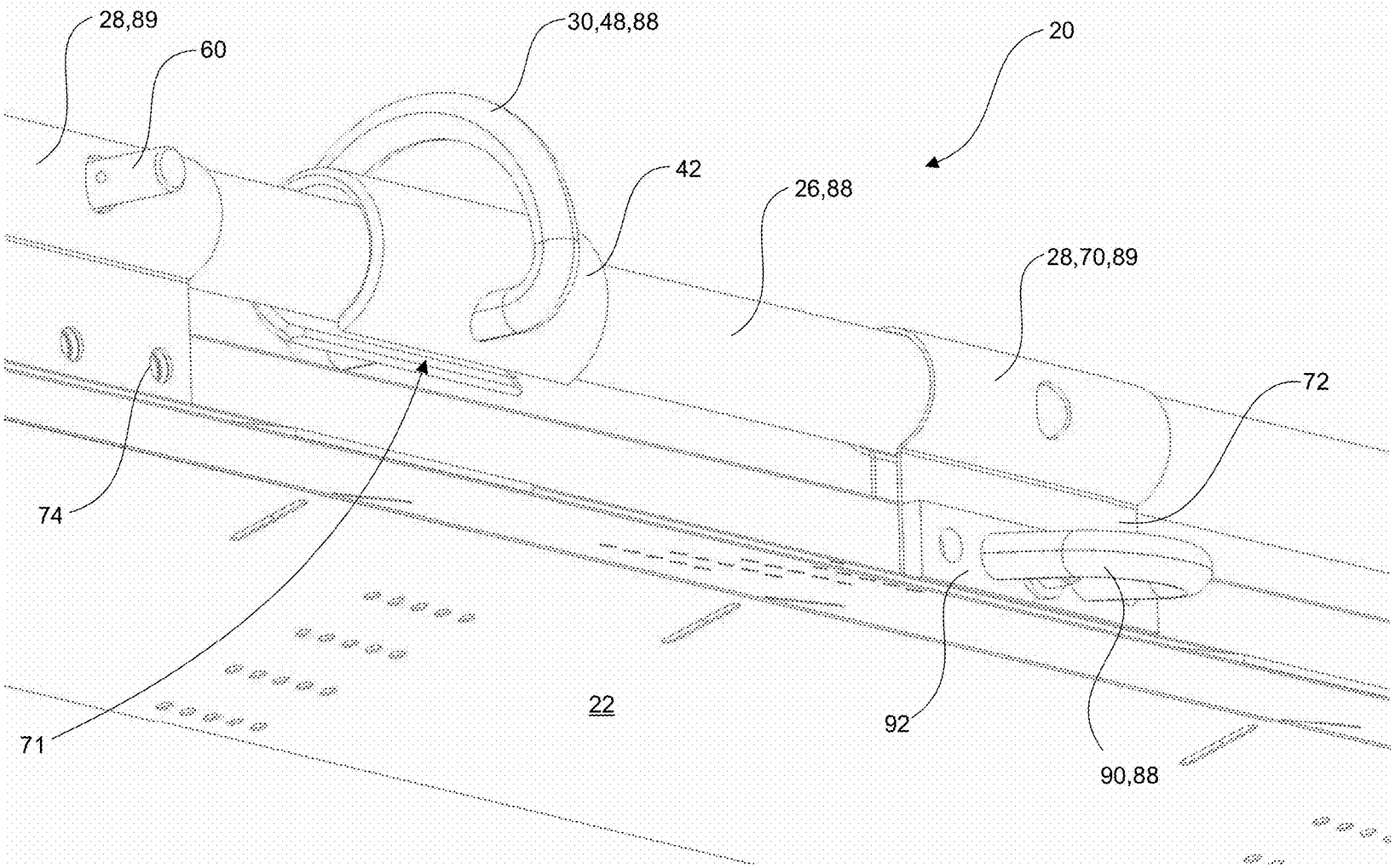
FIG. 10 is a detailed view of a slider and an anchorage connector of the module of FIG. 5; shown without flashings

With reference to FIGS. 1A to 8, 10, and 19A, the module 20 may further comprise the rail 26 and rail clamps 28 for supporting the rail 26. As best shown in FIGS. 8 and 10, each rail clamp 28 has a sleeve portion 70 and a leg portion 72. The sleeve portion 70 has a through bore for receiving a lengthwise section of the rail 26. The leg portion 72 is for attachment to the ridge 54 of structural sheet 22 and the flashing ridge 64. In the illustrated embodiment, the leg portion 72 has two legs extending from the sides of a gap in the circumference of the sleeve portion 70. Each leg of the leg portion 72 has one or more apertures 74 for receiving fasteners therethrough and in alignment with the one or more apertures 74 of the other leg. The one or more apertures 74 of each leg are configured and spaced for alignment with the one or more apertures 56,68 of the ridges 54,64 when the leg portion 72 straddles the ridge 64 with one leg on each lengthwise side of the ridge 64.

With reference to FIGS. 1A to 8, 10, and 19A, the rail 26 is an elongated member for supporting one or more sliders 30 thereon. Slider 30 may sometimes be referred to as a mobile anchorage connector. While the rail 26 is shown to be a tubular member with a through bore, rail 26 may be of other shapes and/or solid construction, such as a solid rod or extrusion, in some embodiments. The outer diameter of rail 26 is sized to be receivable inside the sleeve portion 70 of the rail clamps 28 and vice versa. In some embodiments, rail 26 may include one or more weep holes (not shown) on the underside thereof to prevent water from collecting inside the rail, thereby reducing the likelihood of corrosion and ice-jacking.

As best shown in FIG. 10, one or more sliders 30 are supported on rail 26. Each slider 30 comprises a slider sleeve 42 and a slider anchorage connector 48 supported on the slider sleeve 42. Slider sleeve 42 has a through bore sized to allow the sleeve portion 70 of the rail clamps 28 to pass therethrough. There is a gap 71 in the circumference of slider sleeve 42 that is sized to permit the leg portion 72 of the rail clamps 28 to pass therethrough. Therefore, when slider sleeve 42 is supported on rail 26, which in turn is supported by rail clamps 28, slider sleeve 42 is slidably movable axially along rail 26 without being obstructed by the rail clamps 28 since the gap 71 in slider sleeve 42 allows the leg portion 72 to pass therethrough while the slider sleeve 42 slides past and around the rail clamps 28. The slider anchorage connector 48, which is securely attached to slider sleeve 42, provides an attachment point for a safety line (not shown). The slider anchorage connector 48 may be welded to the slider sleeve 42 but other modes of attachment are possible. In some embodiments, slider anchorage connector 48 and slider sleeve 42 are integrated such that they are part of the same component. In embodiments, the sleeve portion 70 of the rail clamps 28 are configured to fit into radial recesses of the rail 26 to provide a surface of uniform diameter for the slider sleeve 42 to travel along, and reduce the likelihood of the slider sleeve 42 catching on a rail clamp 28.

A module 20 or a plurality of modules 20 may have a plurality of sliders 30 to provide two or more attachment points to which safety lines may attach. Having a plurality of sliders 30 allows more than one person to access the same building structure at a given time and/or provides redundancy in case of unexpected failure of one of the sliders or safety lines.

To stop the slider 30 from sliding beyond a certain axial location of the rail 26, the module 20 comprises one or more stop rods 60. For example, the one or more stop rods 60 help prevent the slider(s) 30 from sliding off at least one end of the rail 26. In the illustrated embodiment, as best shown in FIGS. 1 to 4, the stop rod 60 is an elongated member extending through aligned apertures in one of the rail clamps 28 and the rail 26, such that at least one end of the stop rod extends radially outwardly from the outer surface of the rail clamp 28. In embodiments, the length of the stop rod 60 is selected such that it is at least the same as or greater than the outer diameter of the sleeve 42, and the stop rod 60 is positioned such that both ends extend radially outwardly from the outer surface of rail clamp 28. The module 20 may have a stop rod 60 extending laterally through each outermost rail clamp to restrict the axial movement of the slider 30 to be only between the stop rods 60. In other embodiments, the module 20 may further comprise additional stop rods 60 at different axial locations of the rail 26. This may be useful where the module 20 has multiple sliders 30. For example, by positioning one of the sliders 30 in between a pair of adjacent stop rods 60, the axial movement of that slider 30 can be limited to only between the pair of stop rods 60, thus preventing it from interfering with the movement of other sliders 30.

While the illustrated embodiment shows the stop rod 60 as penetrating laterally through the rail 26 and the rail clamp 28, in other embodiments the stop rod 60 can be positioned at an axial location where the stop rod 60 only penetrates the rail 26. Further, in some embodiments, the stop rod 60 does not extend through the rail 26 or the rail clamp 28. For example, the stop rod 60 may be one or more protrusions on the outer surface of the rail 26 or the sleeve portion 70, such as one or more pieces of material attached to the outer surface of the rail 26 or sleeve portion 70 that extend radially outwardly therefrom. Furthermore, the protrusions may or may not be symmetrical about an axial axis of the rail 26. In embodiments, the length of each protrusion can be at least the same as or greater than the outer radius of the sleeve 42.

In some embodiments, the module 20 comprises one or more anchorage connectors 90, in addition to or in lieu of the rail 26, rail clamps 28, and slider 30, and each anchorage connector 90 provides an attachment point for a safety line (not shown). In the embodiment shown in FIGS. 1 to 4, module 20 has anchorage connectors 90, each fixedly attached to the ridge 54 via the flashing ridge 64 and the leg portion 72 of a rail clamp 28. In other embodiments, for example where rail clamps 28 are omitted or where an anchorage connector 90 is to be positioned somewhere between two adjacent rail clamps, one or more of the anchorage connectors may be fixedly attached directly to the flashing ridge 64, or ridge 54 if the flashing ridge 64 is omitted. Further, while two anchorage connectors 90 are shown in the illustrated embodiment in FIGS. 2 and 4, the module 20 may include fewer or more anchorage connectors 90.

In the illustrated embodiment, each anchorage connector 90 has a base plate 92 having one or more anchorage apertures each for receiving a fastener 94 therethrough. The one or more anchorage apertures in the base plate 92 can be aligned with the one or more apertures 56 of the ridge 54, and optionally the one or more leg apertures 74 of the leg portion 72 of a corresponding rail clamp 28, if present, and the one or more ridge apertures 68 of the ridge 64, if present. Therefore, when the fastener 94 is received in one of the anchorage apertures in base plate 92, the fastener 94 extends laterally through the ridge 54, from one side to the other, and optionally through the flashing ridge 64 and/or the leg portion 72 of one of the rail clamps 28, if present. One or more fasteners 94 may be used to secure each anchorage connector 90 to the ridge 54. In additional or alternative embodiments, the anchorage connector 90 may be welded to the ridge 54, ridge 64, or rail clamp 28. It can be appreciated that other ways of securing the anchorage connector 90 to the ridge 54 (and optionally the ridge 64 and/or rail clamp 28) are also possible.

In embodiments, the module 20 comprises one or more end cable connectors 100 and intermediate cable connectors 110 in addition to, or in lieu of, anchorage connectors 90. Each end cable connector 100 provides an attachment point for a cable (not shown) to which a safety line may be connected, for example via a carabiner or other suitable attachment device. The cable line 101 can be secured to each end cable connector 100 in such a manner so as to be relatively taut and capable of supporting the weight of a person connected thereto via the safety line in the event of a fall. In the embodiment shown in FIG. 18, the module 20 has two end cable connectors 100 and one intermediate cable connector 110, each fixedly attached to the ridge 54 via the flashing ridge 64. In embodiments where flashing ridge 64 is omitted, the cable connectors 100,110 can be attached directly to the ridge 54.

In some embodiments, the module 20 is relatively short and can have only one end cable connector 100 or intermediate cable connector 110 attached thereto. Multiple modules 20 can be mounted to a structure and used in conjunction to support a cable 101. Such short modules 20 can be advantageous, as they require less materials to construct, are easier to transport, and can be replaced individually.

In the illustrated embodiment, each cable connector 100 has a cable base plate 102 having one or more cable base plate apertures 104 for receiving a fastener therethrough. The one or more cable plate apertures 104 can be aligned with the one or more apertures 56 of the ridge 54 and, if present, the one or more ridge apertures 68 of the flashing ridge 64 such that the fasteners can be inserted therethrough to secure the cable connectors 100 to the ridge 54. In other embodiments, the cable connectors 100 can be secured to the ridge 54 via other means, such as by welding. The cable connectors 100 further comprise a cable aperture 108 for an end of the cable thereto. Intermediate cable connector 110 may also be provided, having a generally tubular cable channel 112 instead of a cable aperture 108 for receiving the cable therethrough. One or more intermediate cable connectors 110 can be located between cable connectors 100 for limiting deflection of the cable and maintaining cable tension. It will be appreciated that other methods of limiting deflection of the cable 101 and maintaining tension thereof are possible at intermediate cable connector(s) 110. For example, cable 101 can be enclosed in a ring or a series of bent round bars or other retaining devices that are thusly affixed to ridge 54 and/or flashing ridge 64.

Figure 11:
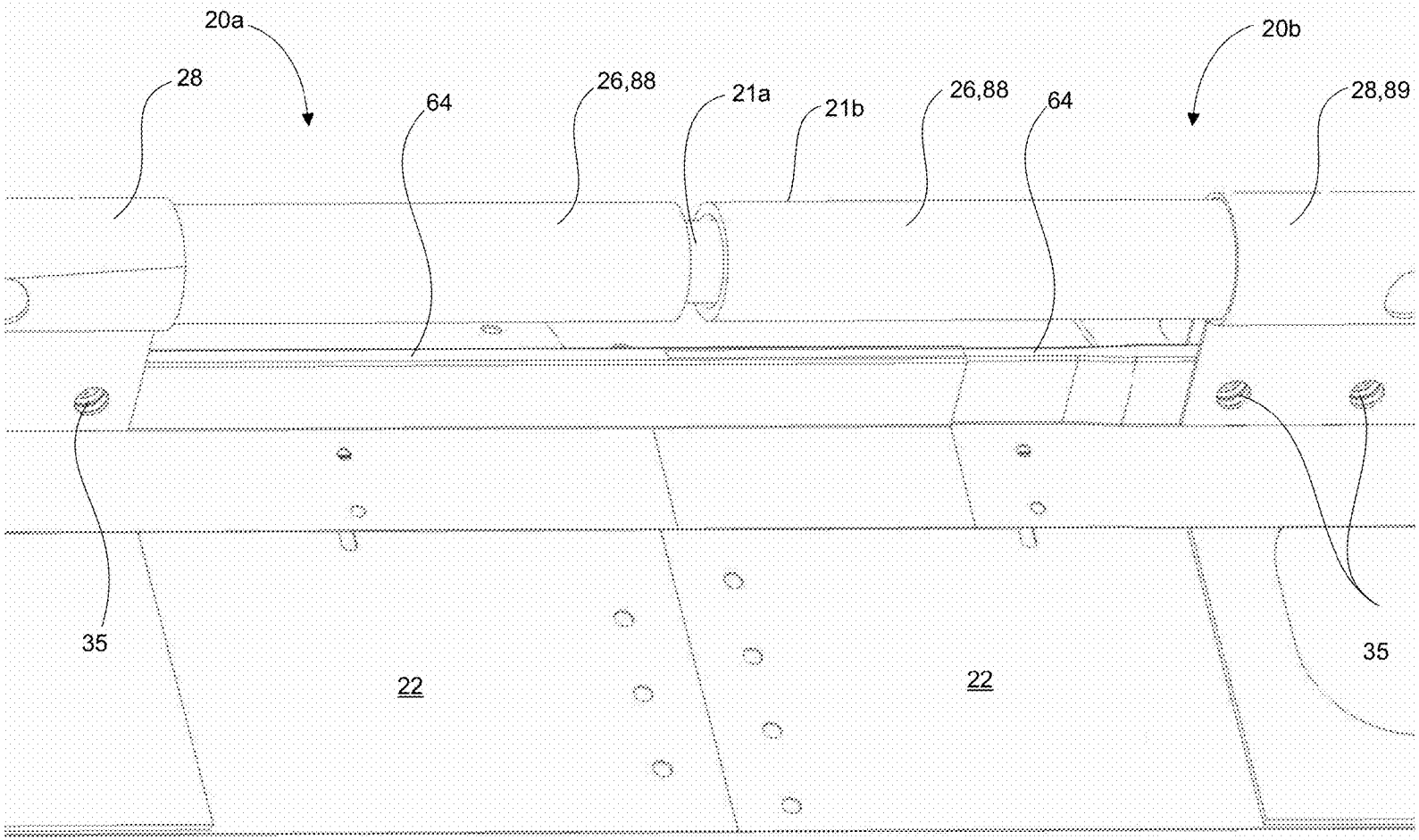
FIG. 11 is a zoomed-in view of the connection between two adjacent modules of the fall protection system, shown without flashings, according to an embodiment of the present disclosure.

With reference to FIG. 11, two or more modules 20*a*,20*b* may be joined together at one end to provide a fall protection system 10 of a desired length. One end of the flashing ridge 64 of one of the modules 20*b* may be thinner to allow a lap joint connection with the end of the flashing ridge 64 of the adjacent module 20*a*. If the modules 20*a*,20*b* have rails 26, then one or both ends of the rail 26 of one of the modules 20*a* may be a male end 21*a*, while the one or both ends of the rail 26 of the adjacent module 20*b* may be a female end 21*b*. The male end 21*a* is sized to be receivable in the female end 21*b*. As a result, the rails 26 of two adjacent modules 20*a*,20*b* can be interconnected by a spigot connection (i.e. by fitting the male end 21*a* of one module 20*a* into the female end 21*b* of the rail 26 of the adjacent module 20*b*). Of course, other modes of connection that are known in the art may be used.

In some embodiments, when two modules 20*a*,20*b* are connected, their respective structural sheets 22 meet at one end. In other embodiments, when two modules 20*a*,20*b* are connected, their respective structural sheets may be selectively sized such that they do not meet at one end, thus leaving a gap between the structural sheets 22. In further embodiments, the flashings 24 of the modules 20*a*,20*b* may or may not cover the gap between the structural sheets. In other words, flashings 24 may be substantially continuous axially across two modules 20*a*,20*b* or there may be a gap between the flashings 24 of two adjacent modules, whereby the modules 20*a*,20*b* are sealed from water ingress independently.

In some embodiments, with reference to FIGS. 1 to 4, the module 20 comprises one or more flashing end sheet 29 at one or both ends of the flashing 24. The flashing end sheet 29 is configured to help shed water at the end(s) of the fall protection system or in between modules if there is a large gap between adjacent flashings 24 or if the adjacent flashings are on different roof pitches. For example, if the fall protection system comprises only one module, a flashing end sheet 29 may be included at each end of the flashings 24 and the flashing end sheets 29 may extend axially beyond the ends of ridge 64. In another example, where the fall protection system comprises multiple modules, a flashing end sheet 29 may only be included at the outer end of the outermost flashings 24. In yet another example, where the fall protection system comprises multiple modules, each module may have flashing end sheets 29 at both ends, especially if there is a gap in the flashings 24 between adjacent modules. The flashing end sheet 29 may be connected to the end of the flashing 24 and where flashing 24 is connected to an adjacent flashing 24 by an S-lock or any other connection as known to those in the art that reduces water migration, allows expansion and contraction of the materials, and/or allows flashings 24 to be fastened to the building structure with hidden fasteners. In some embodiments, the end sheets 29 may be connected to each other, such that flashing 24 may be omitted from the module.

Figure 4:
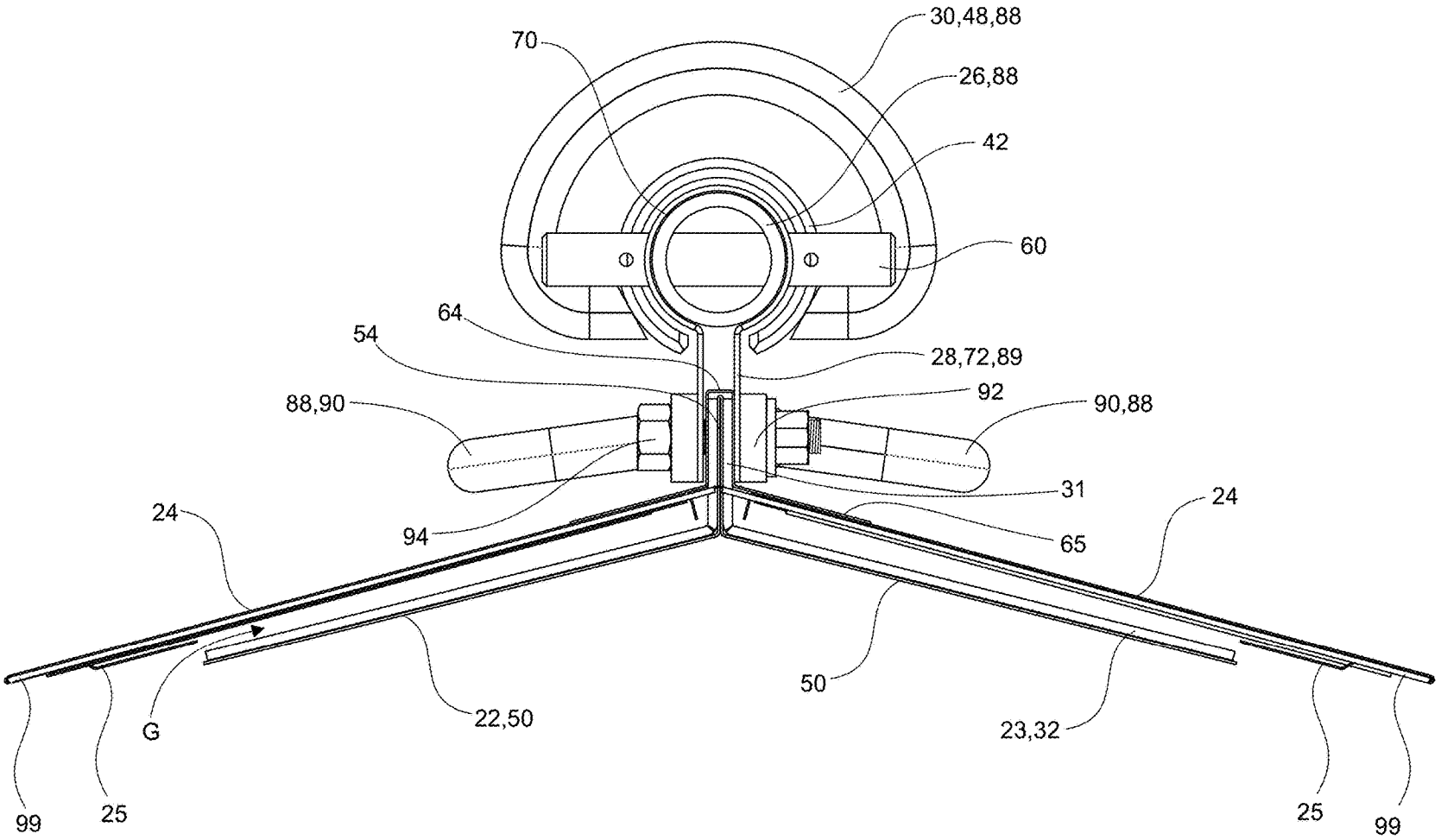
FIG. 4 is an end view of the module of FIG. 1.
Figure 13:
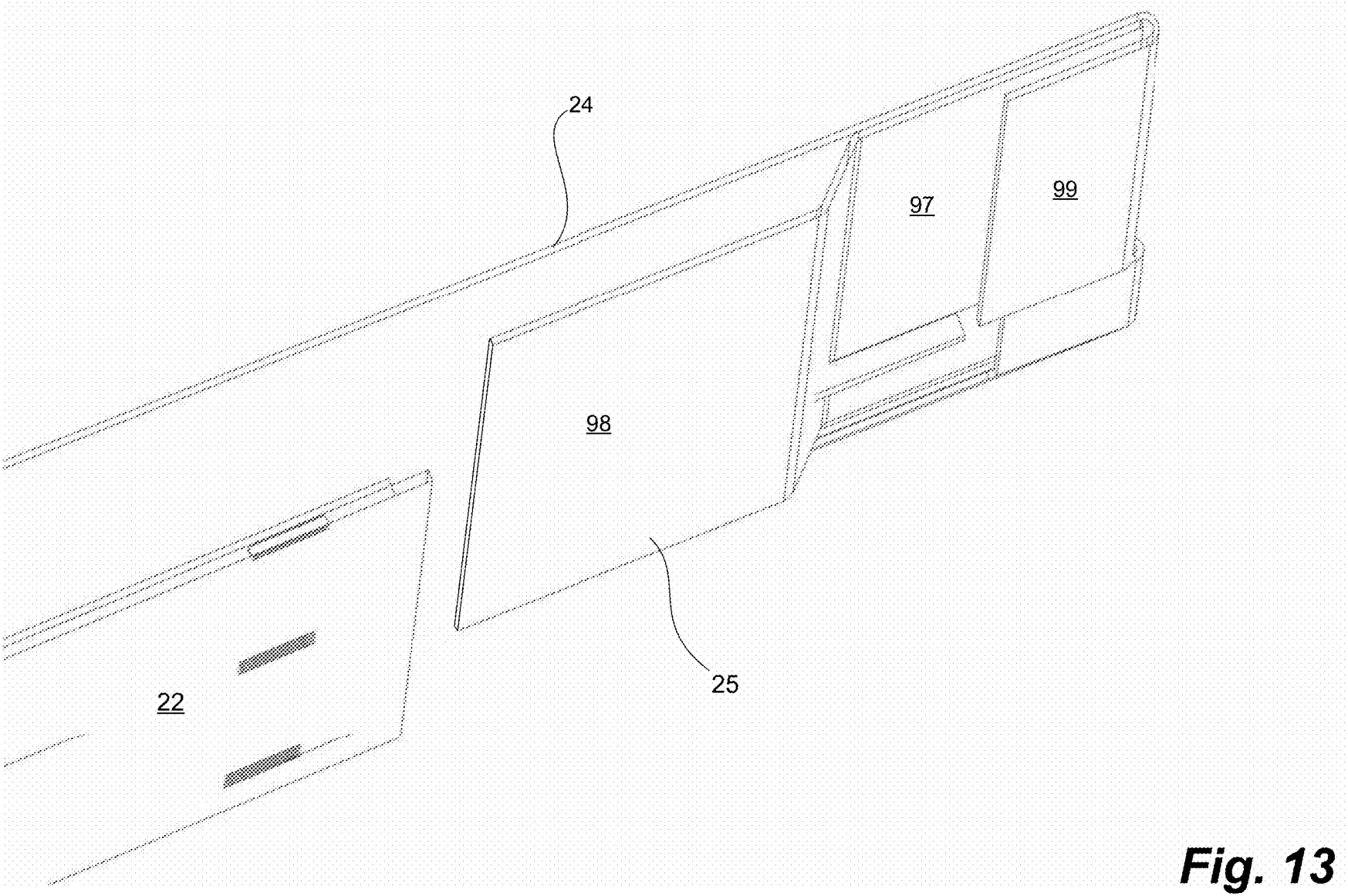
FIG. 13 is a zoomed-in bottom perspective view of the module of FIG. 1, showing a wind clip according to an embodiment.

In some embodiments, the module 20 further comprises one or more wind clips 25 for securing the flashings 24 and flashing end sheets 29 to the structure. In one embodiment, as best shown in FIGS. 4 and 13, the wind clip 25 is a cleat having an axially extending mid portion and an upper wing 97 and a lower wing 98 extending laterally at different heights from the lengthwise sides of the mid portion. The outer edges of the flashings 24 and flashing end sheets 29 may be folded under to provide an open hem 99 for receiving the upper wing 97 of the wind clip 25. The lower wing 98 may be secured to the structure by fasteners or other techniques known to those in the art. When the upper wing 97 is received in the open hem 99 of the flashings 24 (and optionally flashing end sheets 29) and the lower wing 98 is attached to the structure, the wind clip 25 helps the flashings 24 and flashing end sheets 29 resist any uplift as a result of wind, and helps prevent the majority of wind-blown moisture from reaching structural sheet 22.

Figure 12:
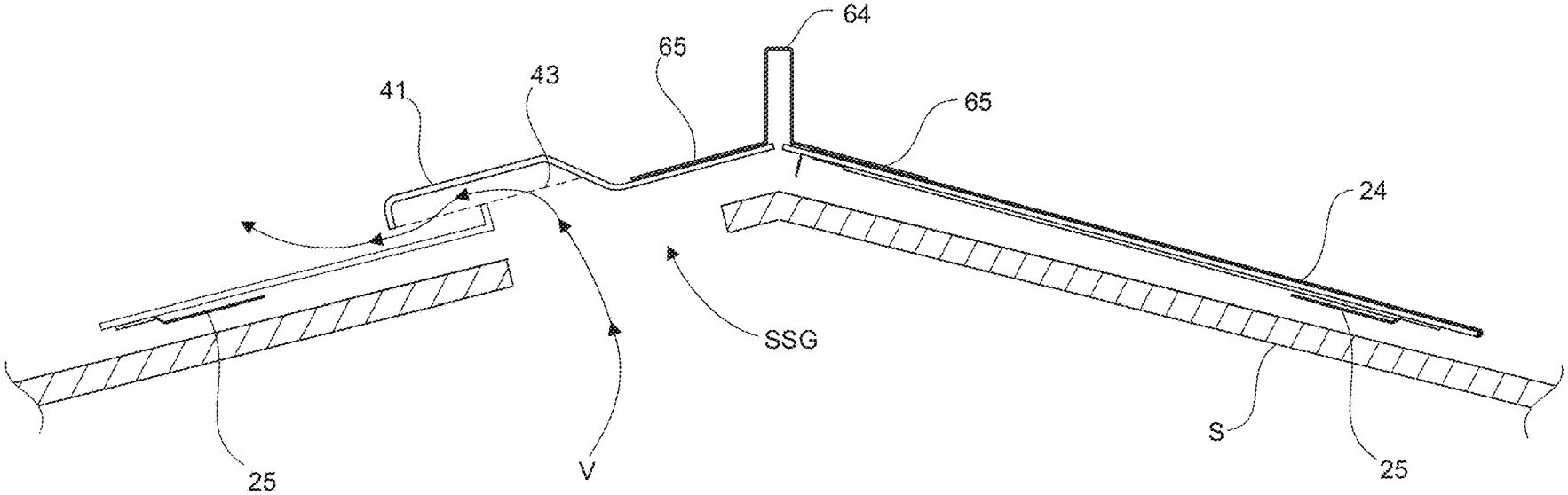
FIG. 12 is a cross-section view of a module of the fall protection system configured to provide ventilation, according to another embodiment.

The fall protection system 10 may be configured to allow ventilation, i.e. to allow air from inside the building structure to exit therethrough. A sample embodiment is shown in FIG. 12. In order to ventilate air through an opening SSG in the sheathing S of a building structure, the fall protection system is configured such that the opening SSG is positioned either (i) in between the structural sheets of two adjacent modules; or (ii) to coincide with a hole in the attachment panel 50, a gap in the attachment panel 50, or a gap in the structural sheet 22 of a module in the fall protection system. In embodiments, the opening in the sheathing S is positioned somewhere between the trusses of the building structure. In whichever configuration, when the fall protection system is secured to the building structure, the opening SSG allows air to pass therethrough.

In the illustrated embodiment in FIG. 12, the opening SSG is positioned in between the structural sheets 22 of two adjacent modules 10. In this embodiment, the fall protection system comprises a vent 41 adjacent to the opening SSG. The vent 41 has a perforated or screen-like surface 43 through which air can flow. The vent 41 may be a box vent. In embodiments, the vent 41 is positioned at or near the opening SSG to allow air inside the building structure to exit via the opening SSG and the perforated surface 43 in the vent 41. The flow path for the air escaping the building structure is denoted by the letter "V". In most embodiments, vent 41 is configured to allow air to flow therethrough without exposing the structural sheet(s) 22 or the sheathing S to water and other elements. In the illustrated embodiment, the gap between flashing 24, ridge 64, and wind clip 25 is filled and sealed by the vent 41. In other words, the gap in flashing 24 is replaced by vent 41. The fall protection system may or may not include vent 41 on both sides of the flashing ridge 64.

Assembly and Installation

The fall protection system 10, comprising one or more modules 20, may be assembled and installed, for example, as follows:

i) attaching the structural sheet 22 of the modules 20 to the building structure by fasteners, such as screws, bolts, hooks and nuts, etc., through the apertures 34 at the attachment locations 33 in the attachment panel(s) 50;

ii) optionally, aligning one or more structural stiffeners 23 with the apertures of the ridge 54 of each corresponding module 20;

iii) restraining lateral movement of the ridge 54 of the modules 20 using the one or more restraining mechanisms 36, such as by bending restraining tabs 38 of the attachment panels 50 to engage the stiffeners 23, securing the stiffeners 23 to the attachment panels 50 using restraining fasteners 40, or welding the stiffeners 23 to the attachment panels 50;

iv) placing the flashing ridge 64 over the ridge 54 of each module 20 such that ridge 54 is matingly received in the channel 67 of ridge 64;

v) aligning the apertures 56 of the ridge 54 with the apertures 68 of the ridge 64;

vi) optionally, attaching the lower wing 98 of a wind clip 25 to the building structure, adjacent a lengthwise side of attachment panel 50;

vii) attaching a flashing 24 on one or both length sides of the ridge 64, which may be done prior to or after placing ridge 64 over ridge 54, and if the wind clip 25 is included, fitting the upper wing 97 of the wind clip into the open hem 99 of the flashing 24 prior to attaching the flashing to the side flange 65 of ridge 64; and viii) one or a combination of:

a. feeding the rail 26 through the sleeve portion 70 of the plurality of rail clamps 28 of the modules 20, such that the rail clamps 28 are intermittently spaced apart on the rail 26; placing the leg portion 72 of the plurality of rail clamps 28 on to the ridge 64 of the modules 20 with the legs of the leg portion straddling the ridge 64; aligning the apertures 74 in the leg portion 72 with the apertures in ridges 54,64; securing the rail clamps 28 to ridges 54,64 using fasteners, such as nuts and bolts, at the aligned apertures; sliding the sleeve of the one or more sliders 30 on to the rail 26 from one end of the rail; and inserting a stop rod 60 at or near each end of the rail 26; and b. attaching one or more anchorage connectors 90 to ridge 54 (and ridge 64, if present) of the modules 20 by aligning the one or more apertures of the base plate 92 of anchorage connector 90 with one or more of the apertures of ridges 54,64 (and optionally the apertures in the rail clamp 28, or cable connectors 100,110, if included) at a desired location of ridge 54 and attaching the base plate to the ridge 54 using fastener 94;

c. attaching one or more end cable connectors 100 and intermediate cable connectors 110 to ridge 54 (and ridge 64, if present) of the modules by aligning the one or more apertures of the cable connectors 100, 110 with one or more of the apertures of ridges 54,64 at a desired location of the ridge 54 and attaching the connectors to the ridge 54 using a fastener;

ix) optionally, further securing ridge 64 to ridge 54 using fasteners, such as nuts and bolts, at any remaining aligned apertures.

Some or all of the attachment locations 33 of the modules 20 may be aligned with the trusses of the building structure so that the structural sheet 22 is attached to one or more trusses via the fasteners. For installation on a roof, the attachment locations 33 of the structural sheet 22 may be spaced to align with the principal and/or common rafters or diaphragm, if applicable, to allow the structural sheet 22 to be attached to same directly or indirectly. The modules 20 may be used on wood truss roofs, roofs of asphalt and/or metal construction, tile roofs, sloped roofs, flat roofs, etc. Further, the modules 20 may be fabricated to have the spacing of attachment locations 33 coincide with the underlying structure. In some embodiments, shingles may be installed on the roof after the modules 20 are in place and the shingles or a flexible membrane may partially cover the structural sheet 22 or vice versa.

To fit different building structures, the length of the fall protection system 10 may be configured and customized by: (i) selecting (or cutting) a module 20 of a desired length and width; (ii) connecting a plurality of modules 20 in series, as described above; and/or (iii) using a group of unconnected modules 20. Of course, other configurations may be possible. For installation on a roof, the fall protection system may be customized according to the roof pitch and the underlying structure (e.g. truss spacing or roof panel spacing of the roof). To fit a variety of structures, the fall protection system may be configured and/or customized to align with an intermediate fixture(s) to facilitate attachment to the aforementioned structure.

Figure 19A:
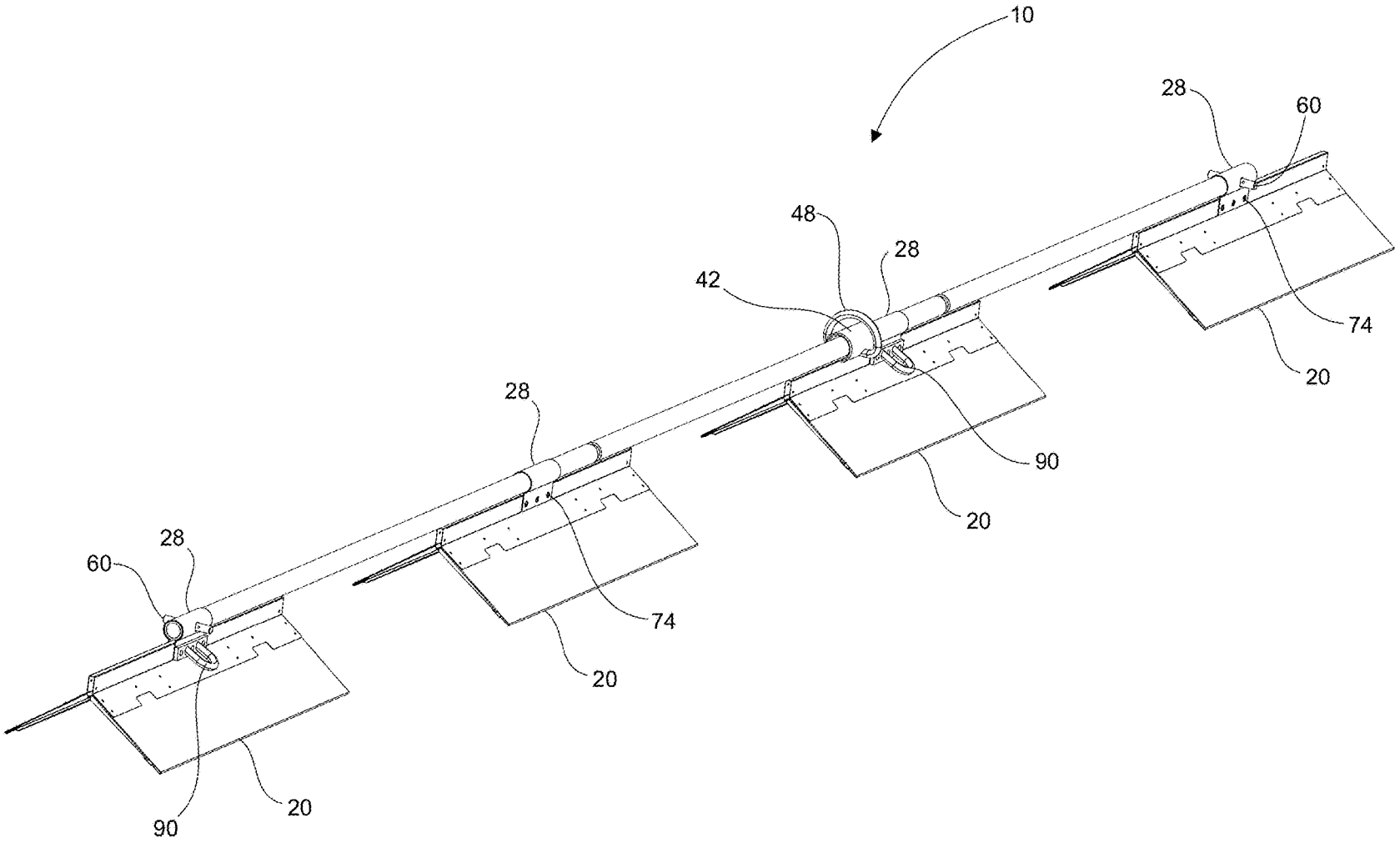
FIG. 19A is a perspective view of an embodiment of a fall protection system comprising multiple fall protection modules.
Figure 19B:
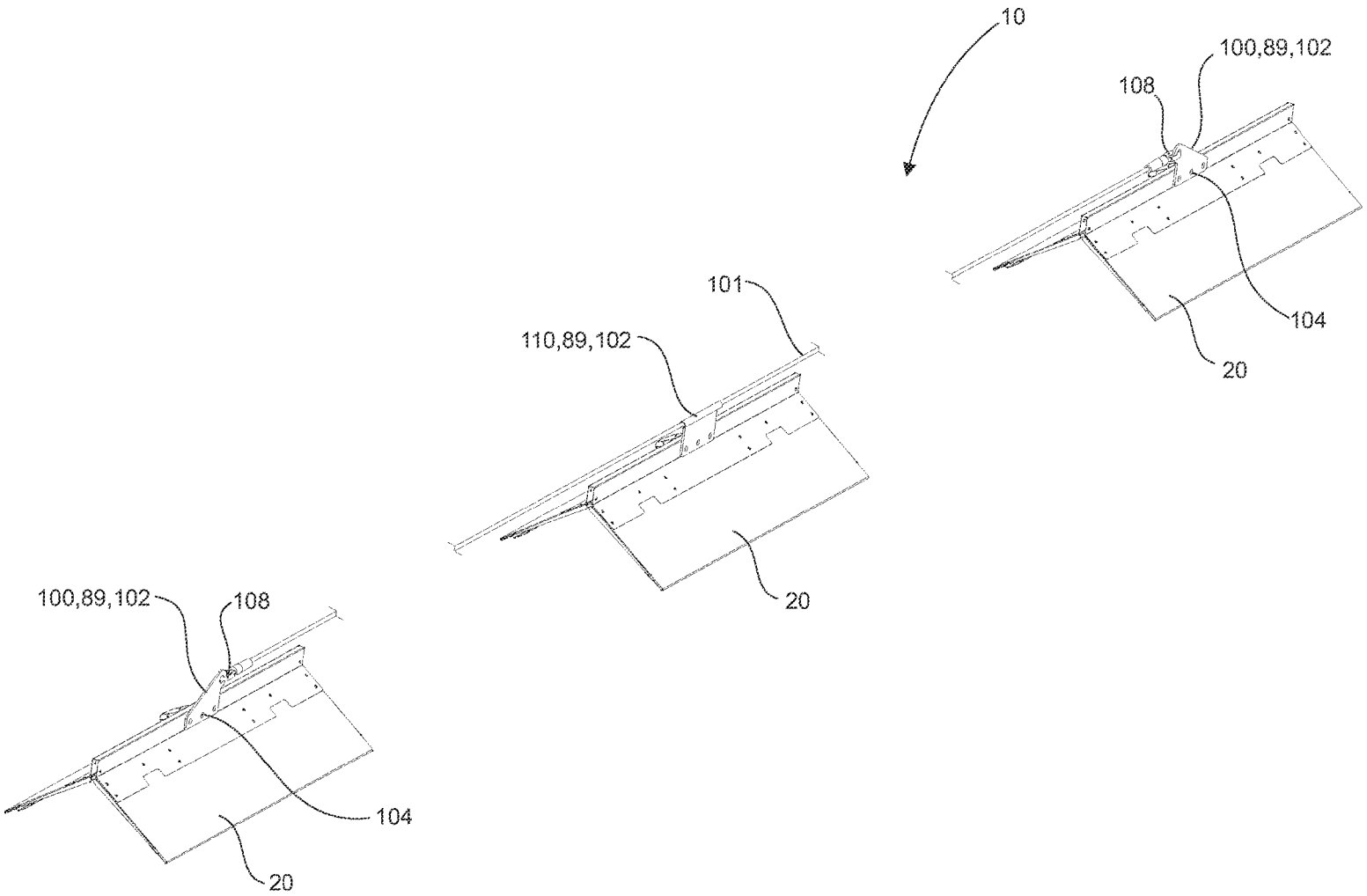
FIG. 19B is a perspective view of another embodiment of a fall protection system comprising multiple fall protection modules.

In embodiments, with reference to FIGS. 19A and 19B, the fall protection system 10 may comprise multiple modules 20 cooperating to support a rail 26 or a cable 101. Such modules 20 can each have a single rail clamp 28 or cable connector 100,110 and thus be of a relatively short axial length. Such compact modules 20 are easier to transport, replace, and provide flexibility as to the spacing of rail clamps 28 and cable connectors 100,110.

If the rail 26 has a free end, i.e. an end that is not connected to the rail of another module, a stop rod 60 may be included near the free end to prevent the slider(s) 30 from sliding off the rail 26 at the free end. This is especially important where the free end is near an edge of the building structure when the module 20 is installed and where parallel loading may occur.

The fall protection system 10, the modules 20, or any part thereof may be preassembled or assembled on site prior to installation on a structure. Alternatively, the modules 20 may be assembled after the structural sheet 22 is installed on the building structure. Further, the fall protection system may be installed during the construction of the building structure or retrofitted on to an existing building structure. The fall protection system 10 may be left on the building structure as a permanent fixture, thereby allowing future use without the need for reinstallation.

While the present disclosure only describes using fasteners to assemble the various components of the fall protection system 10 and to attach the fall protection system 10 to the building structure, one skilled in the art can appreciate that other attachment techniques may be used.

Safety Features

Once the fall protection system 10 is installed on a building structure, a user attached to the fall protection system via a user attachment point 88 such as an anchorage connector 90, rail 26, or cable 101, via a safety line of a suitable length, can use the attachment point 88 as a discrete fall protection tie-back or as a way to safely suspend from the building structure. When the user is suspended from the building structure via the attachment point 88, the force exerted by the user's weight at the attachment point 88 is transmitted and spread throughout the structural sheet 22. Accordingly, the fall protection system 10 is configured to safely support the user's weight or potential fall at the user attachment point 88.

When the user is attached to the installed fall protection system 10 at the anchorage connector 90, via a safety line of a suitable length, the user is permitted limited movement about the building structure while being secured thereto. In embodiments wherein the user is attached to the anchorage connector 48 of the slider 30 connected to the rail 26, or to the cable 101, the user can move continuously about the building structure while being secured thereto, the range of movement limited by the distance between adjacent stop rods 60 of the rail 26 or end cable connectors 100 between which the safety line is connected. In the event that the user falls, the falling force is exerted on the user attachment point 88 and at least some of that force is transmitted to the restraining mechanisms 36. As the threshold force of the restraining mechanisms 36 is selected to be less than the pre-determined force, the exerted falling force causes the restraining mechanisms 36 to fail or deform, thereby absorbing at least some of the energy of the falling force. After the restraining mechanisms 36 fail, any further falling force is transmitted to the ridge 54, attachment panels 50, and stiffeners (if present), some or all of which deform to further absorb the energy of the falling force. Thus, the risk of injury to the user is reduced and damage to the building structure is mitigated. In some embodiments, the failure or deformation of the restraining mechanisms 36, ridge 54, attachment panels 50, stiffeners 23, and other components of the structural sheet 22 may be plastic, the deformation may resemble "wrinkles", especially where the stress is the most concentrated. The amount of deformation, thus the amount of energy absorbed by the restraining mechanism 36 and other components of the module 20, depends on the magnitude, location, and direction of the force.

In embodiments, the stiffeners 23 can be configured to deform after a force greater than the threshold force is exceeded, such that the stiffeners 23 do not deform until after the restraining members 36 deform.

In embodiments wherein the user is secured to a rail 26 or cable 101 of the modules 20, the falling force on the slider anchorage connector 48 or cable 101 may also cause deflection of the rail 26, rail clamps 28, cable connectors 100,110, and/or ridges 54,64. Such deflection also helps absorb some of the energy of the fall. The deformation and deflection of the fall protection system 10 may also help reduce uplift on the fasteners of the attachment panel 50 opposite the fall by decreasing moment and increasing shear loading. The force applied to the rail 26 is transferred to at least one clamp 28, which in turn distributes the force to at least two rows of apertures 34, thereby reducing the point loads to the structure. In other words, the spacing of the rail clamps 28 helps distribute the load to at least two attachment locations 33 of the structural sheet. Likewise, the force applied to the cable 101 is transferred to the at least two end cable connectors 100 and intermediate cable connectors 110, also distributing the falling force.

Where the fall protection system 10 comprises two or more modules 20 connected in series, it may be possible to replace the deformed module(s) 20 in isolation without uninstalling and reinstalling the remaining intact module(s) 20.

Figure 14A:
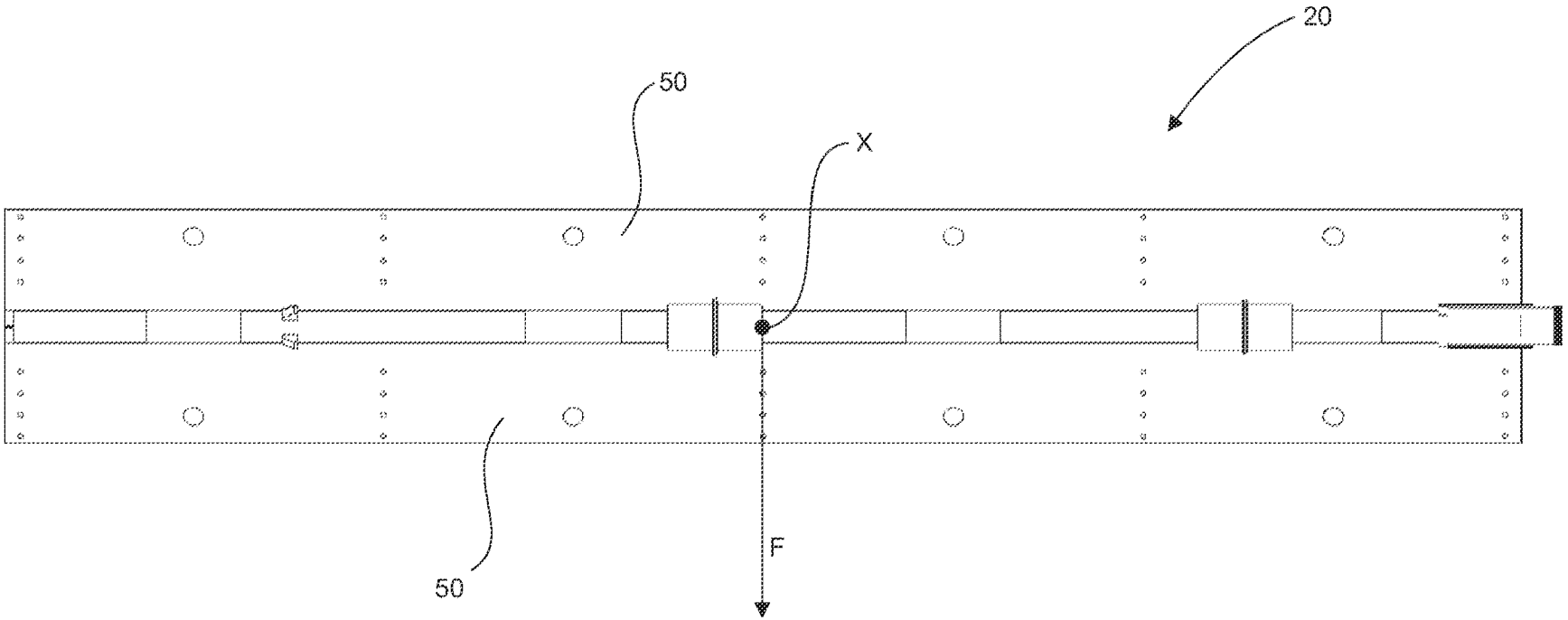
FIG. 14A is a schematic representation depicting a force exerted on a sample fall protection system in one experiment.
Figure 14B:
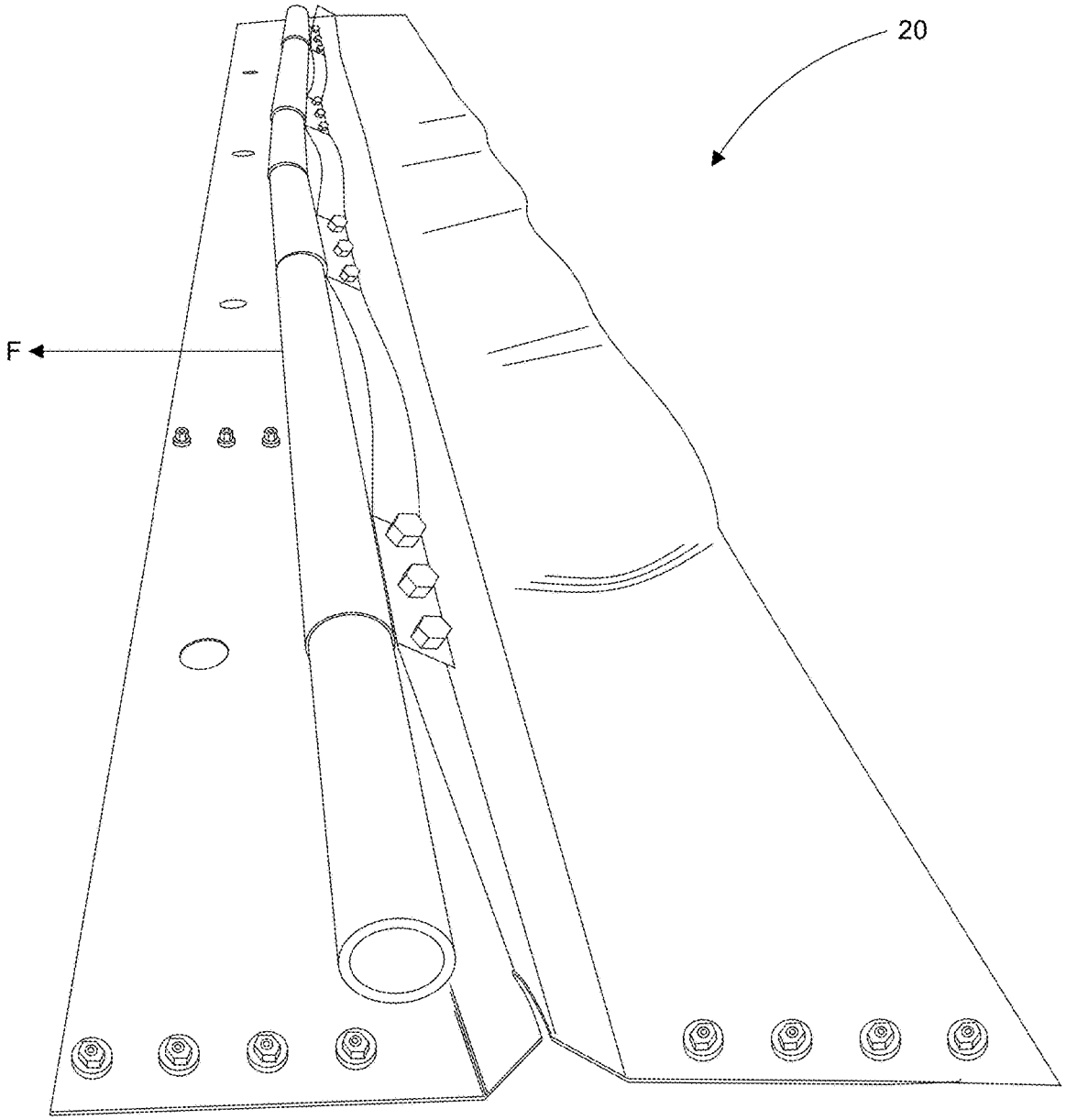
FIG. 14B is an illustration showing the resulting deformation of the fall protection system depicted in FIG. 14A.
Figure 15A:
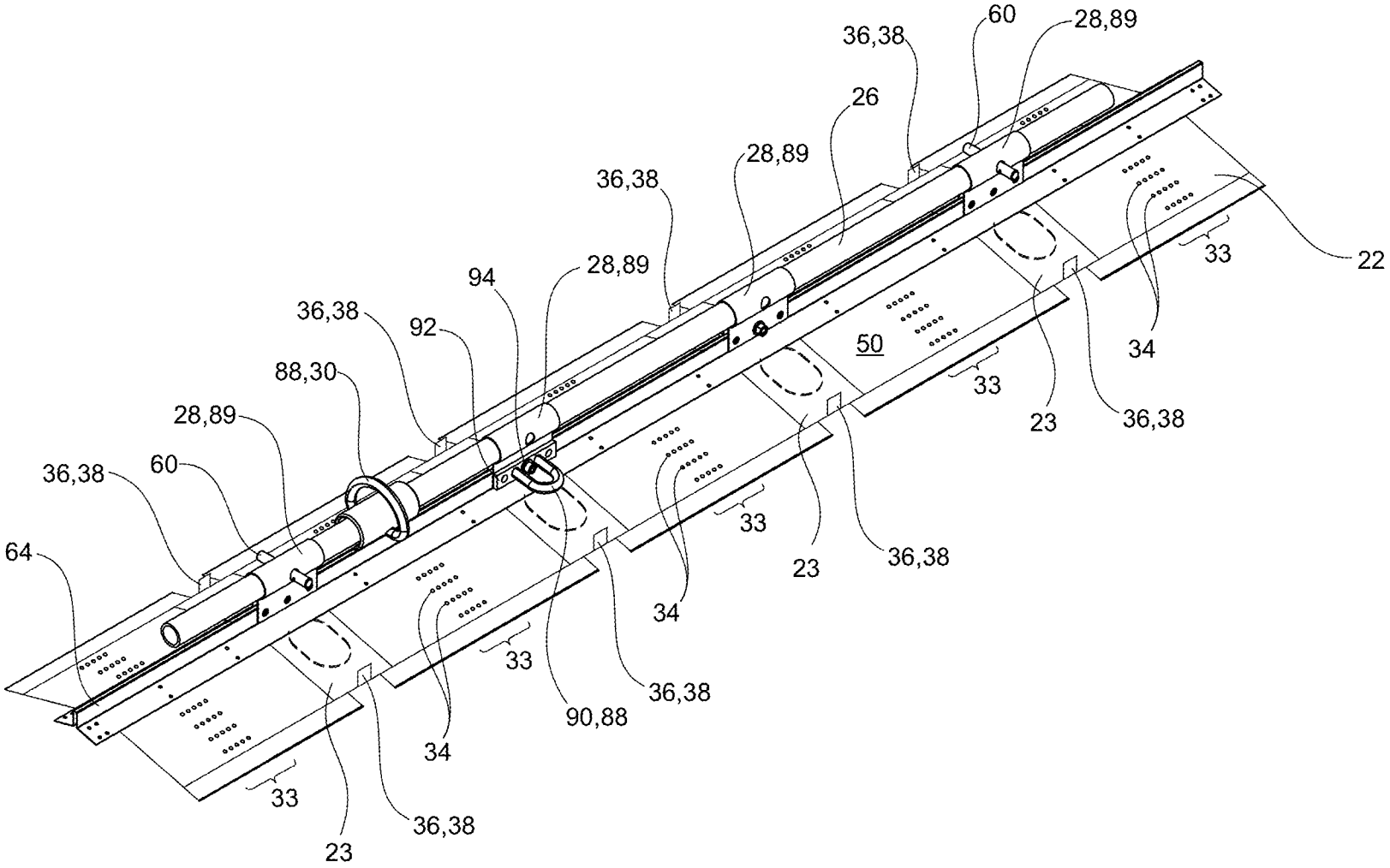
FIG. 15A is a perspective view of a module of the fall protection system, according to one embodiment of the present disclosure wherein restraining tabs resist lateral movement and deformation of a ridge of the module.
Figure 15B:
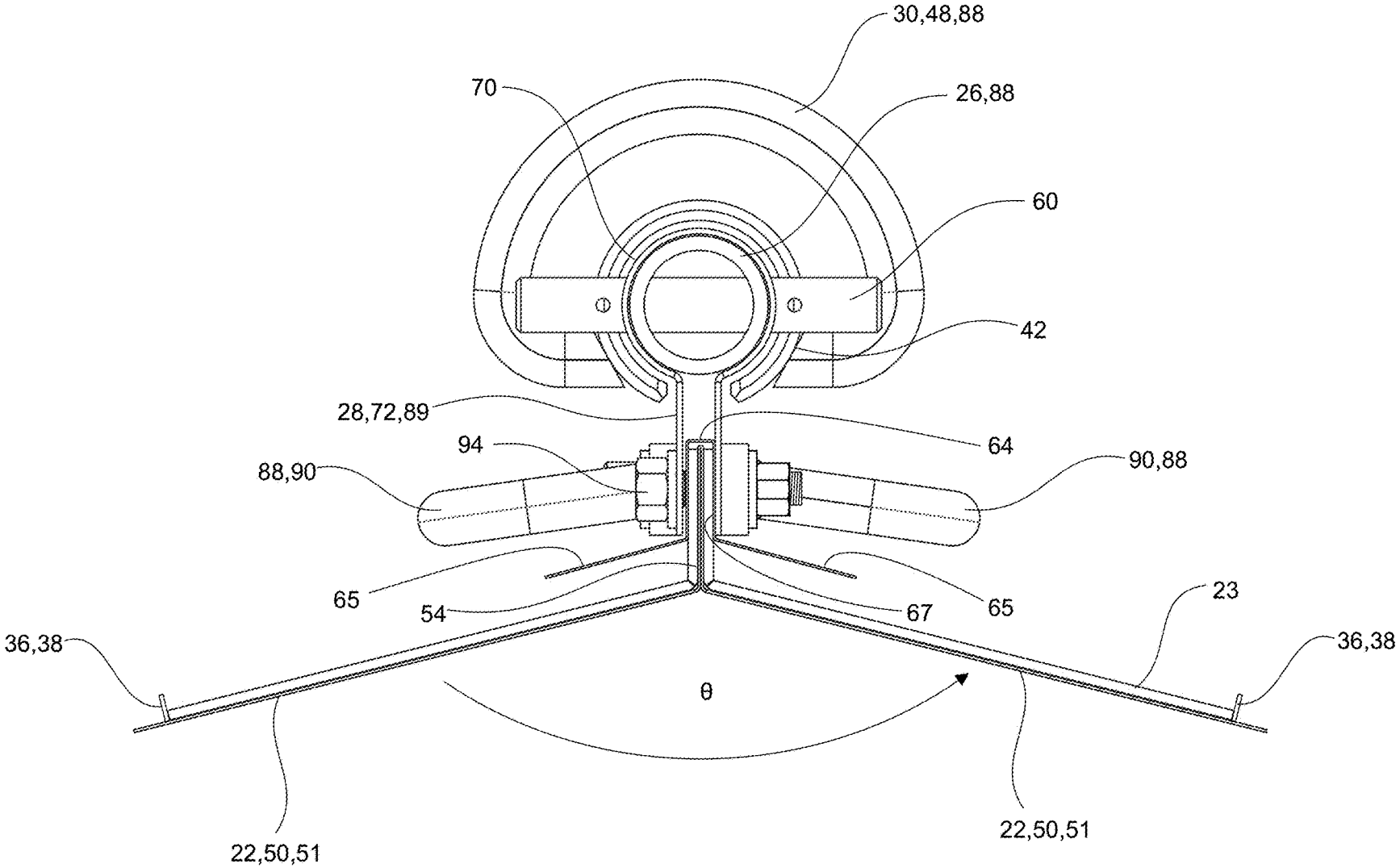
FIG. 15B is an end view of the module of FIG. 15A.

With reference to FIG. 14A, an experiment was conducted on the fall protection system installed on a rigid structure. A force F of approximately 9500 lbs. was exerted at a location X of the rail as shown in FIG. 14A. The resulting deformation of the fall protection system, especially the structural sheet, is shown in FIG. 14B.

In some embodiments, the structural sheet 22 and/or the flashings 24 are provided in one or more standard lengths so as to be able to create a longitudinally continuous fall protection system of any size.

The fall protection system can be installed on a variety of structures, including roofs with any pitch and, utilizing the integrated flashing system, can thereby ensure waterproofing. The fall protection system can be adapted to any type of roof system (e.g. asphalt shingles, metal tile, etc.) and allow multiple operators to work safely simultaneously.

The fall protection system also allows direct safety line attachment to the rail 26, which may not be possible in many other low-profile rail systems.

The fall protection system protrudes to a minimal extent with respect to the ridge of the roof. The fall protection system may be particularly advantageous for roofs on which photovoltaic systems are to be installed, since the fall protection system may facilitate the installation of such systems, using all the surface of the roof, and casts minimal shadows on the panels by virtue of its reduced vertical profile, with its primary location at the peak of the roof.

The speed and simplicity of installation of the fall protection system may reduce the costs and inconvenience for the end user.

The fall protection system combines the ease of use of a cable or rail system with the advantages of a deformable anchor while also potentially eliminating the excessive deflections caused by cable systems and enabling the load to be spread about the structure.

Contrary to conventional safety rail systems, the fall protection system provides a structural sheet and flashing system as an integral part of a structure, substituting the shingles or other covering members at the ridge of the roof.

Accordingly, fall protection systems for use on a structure are described herein. In embodiments, the fall protection system comprises a module comprising: a structural sheet having a ridge with two lengthwise sides, one or both of the lengthwise sides having a respective attachment panel extending laterally therefrom, the attachment panel being attachable to the structure; and one or all of: (i) an anchorage connector attached to the ridge; (ii) at least one rail clamp attached to the ridge; a rail supported by the at least one rail clamp; and a slider supported on the rail, the slider being slidably movable axially along the rail, and the slider having a slider anchorage connector, and (iii) an end or intermediate cable connector 100,110 and cable 101 attached to or passed therethrough.

In some embodiments, each of the at least one rail clamp has a leg portion, and the leg portion is attached to the ridge. In some embodiments, each of the at least one rail clamp has a sleeve portion, and the rail extends through and is supported by the sleeve portion.

In some embodiments, the module further comprises a flashing ridge having two lengthwise sides and wherein the flashing ridge is attached to the ridge.

In some embodiments, the ridge and the flashing ridge each have one or more attachment sections and the flashing ridge has an inner channel, wherein a portion of the ridge is received in the inner channel, wherein at least one of the one or more attachment sections of the flashing ridge is aligned with at least one of the one or more attachment sections of the ridge to provide at least one aligned attachment section, and wherein the flashing ridge is attached to the ridge at the at least one aligned attachment section.

In some embodiments, one or both of the lengthwise sides of the flashing ridge have a respective flashing extending laterally therefrom.

In some embodiments, the respective flashing corresponds to the respective attachment panel to provide coverage for at least a portion of the respective attachment panel.

In some embodiments, a gap is defined between the respective flashing and the corresponding respective attachment panel.

In some embodiments, the slider has a slider sleeve, the slider sleeve having an inner diameter that is greater than an outer diameter of the rail portion.

In some embodiments, the slider has a slider sleeve, the slider sleeve having a gap that is sized to fit the leg portion of the rail clamp therethrough.

In some embodiments, the module comprises the rail and the at least one rail clamp and further comprises one or more stop rods, and wherein at least a portion of each of the one or more stop rods extends radially outwardly from an outer surface of the rail or one of the at least one rail clamp.

In some embodiments, both of the lengthwise sides have the respective attachment panel, wherein an angle is defined between the respective attachment panels, and wherein the angle ranges from about 0° to about 180°.

In some embodiments, the module further comprises a flashing end sheet at one or both ends of the respective flashing.

In some embodiments, the module further comprises one or more wind clips.

In some embodiments, one or both of the respective flashing and the flashing end sheet comprise an open hem at an outer edge and a portion of one of the one or more wind clips is received in the open hem.

In some embodiments, the fall protection system further comprises a vent.

In some embodiments, the module further comprises one or more stiffeners.

In some embodiments, the fall protection system further comprises a second module, the second module comprising: a second structural sheet having a second ridge having two lengthwise sides, one or both of the lengthwise sides having a respective second attachment panel extending laterally therefrom, the second attachment panel being attachable to the structure.

In some embodiments, the module and the second module are connected in series.

In some embodiments, the fall protection system further comprises a flashing ridge having two lengthwise sides, the flashing ridge being attached to one or both of the ridge and the second ridge, wherein one or both of the lengthwise sides of the flashing ridge have a respective flashing extending laterally therefrom, and wherein the respective flashing provides coverage for one or both of at least a portion of the respective attachment panel and at least a portion of the respective second attachment panel.

In some embodiments, the second module further comprises one or all of: (i) a second anchorage connector attached to the second ridge; (ii) at least one second rail clamp attached to the second ridge; and a second rail supported by the at least one second rail clamp; and (iii) end or intermediate cable connector connected to the second ridge.

In some embodiments, the rail is one and the same as the second rail.

Methods for assembling a fall protection system are also described herein. According to some embodiments, the method comprises: attaching an attachment panel of a structural sheet to a structure, the structural sheet comprising a ridge having two lengthwise sides, the attachment panel extending laterally from one of the lengthwise sides; and one or both of: (i) attaching an anchorage connector to ridge; and (ii) feeding a rail through a plurality of rail clamps; attaching the plurality of rail clamps to the ridge; and placing a slider on the rail, the slider being slidably movably axially along the rail, the slider having a slider anchorage connector.

In some embodiments, the method further comprises, subsequent to attaching the attachment panel, securing a flashing ridge to the ridge, the flashing ridge having a first end and two lengthwise sides; and attaching a flashing to the flashing ridge at one of the lengthwise sides, the flashing extending laterally from the one of the lengthwise sides to provide coverage for at least a portion of the attachment panel.

In some embodiments, the method further comprises attaching a flashing end sheet at one or both ends of the flashing.

In some embodiments, the method further comprises, prior to attaching the flashing to the flashing ridge, attaching a first wing of a wind clip to the structure; and engaging a second wing of the wind clip with the flashing.

In some embodiments, the attachment panel is attached to one or more of a principal rafter of the structure, a common rafter of the structure, an underlying structure, an addition to the structure, and an intermediate fixture attached to the structure.

In some embodiments, the method further comprises connecting the first end of the flashing ridge to a second end of a second flashing ridge, wherein the second flashing ridge is secured to a ridge of a second structural sheet; and attaching an attachment panel of the second structural sheet to the structure.

In some embodiments, the method further comprises, subsequent to placing a slider on the rail, installing one or more stop rods on the rail.

In some embodiments, the method further comprises attaching a safety line directly to the rail.

Kits for a fall protection system are also described herein. According to some embodiments, the kit comprises: a structural sheet having a ridge with two lengthwise sides, one or both of the lengthwise sides having a respective attachment panel extending laterally therefrom, and one or all of: (i) an anchorage connector for attachment to the ridge; (ii) at least two rail clamps for attachment to the ridge; a rail supportable by the at least two rail clamps; and a slider supportable on the rail and slidably movable axially along the rail, and the slider having a slider anchorage connector; and (iii) an end or intermediate cable connector for attachment to the ridge.

In some embodiments, each of the at least two rail clamps has a respective sleeve portion and a respective leg portion, the respective leg portion for attachment to the ridge and the respective sleeve portion for receiving a portion of the rail.

In some embodiments, the kit further comprises one or more stop rods.

In some embodiments, the kit further comprises a flashing ridge for attachment to the ridge; and at least one flashing attachable to a lengthwise side of the flashing ridge.

In some embodiments, the kit further comprises one or more flashing end sheets.

In some embodiments, the kit further comprises one or more wind clips.

In some embodiments, the kit further comprises a vent.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A fall protection module for use on a structure, comprising:

a ridge with two lengthwise sides, at least one of the lengthwise sides having a respective attachment panel extending laterally therefrom, the attachment panel being attachable to the structure;

one or more stiffeners connected to the ridge and extending laterally therefrom;

one or more user attachment points secured to the ridge; and one or more restraining mechanisms configured to restrain at least lateral movement of the ridge up to a threshold force and to deform after the threshold force is exceeded.

2. The fall protection module of claim 1, wherein the one or more restraining mechanisms are one or more tabs extending from each attachment panel and configured to engage a respective stiffener of the one or more stiffeners to restrain at feast lateral movement of the ridge.

3. The fall protection module of claim 1, wherein the one or more restraining mechanisms are one or more fasteners securing each attachment panel to a respective stiffener of the one or more stiffeners, wherein the fasteners are configured to fail when the threshold force is exceeded.

4. The fall protection module of claim 3, wherein the fasteners comprise one of a shear screw, shear pin, rivet, or a combination thereof.

5. The fall protection module of claim 1, wherein the one or more restraining mechanisms are welds between each attachment panel and a respective stiffener of the one or more stiffeners, wherein the welds are configured to fail when the threshold force is exceeded.

6. The fall protection module of claim 1, wherein the one or more stiffeners are further configured to deform when a second force greater than the threshold force is applied.

7. The fall protection module of claim 1, wherein the threshold force is less than a pre-determined force and greater than a load testing force.

8. The fall protection module of claim 1, wherein the one or more user attachment points comprise one of:

(i) an anchorage connector attached to the ridge;

(ii) a rail extending through at least one rail clamp attached to the ridge;

(iii) a slider supported on the rail and slidably movable therealong; and (iv) a cable secured to at least one cable connector attached to the ridge;

or a combination thereof.

9. The fall protection module of claim 1, further comprising one or more flashings attached to the ridge and extending laterally therefrom.

10. A method for assembling a fall protection module, the method comprising:

providing one or more attachment panels connected to a respective lengthwise side of a ridge, the ridge and the one or more attachment panels being formed from a single structural sheet;

securing one or more user attachment points to the ridge;

restraining the ridge against at least lateral movement with a restraining mechanism;

wherein the restraining mechanism is configured to permit lateral movement of the ridge after a threshold force is exceeded.

11. The method of claim 10, wherein the step of restraining the ridge further comprises securing one or more stiffeners connected to a respective lengthwise side of the ridge to a corresponding attachment panel of the one or more attachment panels.

12. The method of claim 11, wherein:

the restraining mechanism comprises one or more tabs extending from each of the attachment panels;

the step of restraining the ridge further comprises bending the tabs to engage a corresponding stiffener of the one or more stiffeners; and the one or more tabs are configured to deform when the threshold force is exceeded.

13. The method of claim 11, wherein the step of restraining the ridge comprises securing the one or more stiffeners to a respective attachment panel of the one or more attachment panels with one or more fasteners, the fasteners configured to fail when the threshold force is exceeded.

14. The method of claim 13, wherein the fasteners comprise one of shear screws, shear pins, rivets, or a combination thereof.

15. The method of claim 11, wherein the step of restraining the ridge comprises welding the one or more stiffeners to a respective attachment panel of the one or more attachment panels.

16. The method of claim 10, wherein the one or more user attachment points comprise one of:

(i) an anchorage connector attached to the ridge;

(ii) a rail extending through at least one rail clamp attached to the ridge;

(iii) a slider supported on the rail and slidably movable therealong; and (iv) a cable secured to least one cable connector attached to the ridge;

or a combination thereof; and the step of securing one or more user attachment points to the ridge further comprises replacing one of the one or more user attachment points with another type of user attachment point.

17. A fall protection module for use on a structure, comprising:

a ridge with two lengthwise sides, at least one of the lengthwise sides having a respective attachment panel extending laterally therefrom, the attachment panel being attachable to the structure;

one or more user attachment points secured to the ridge; and one or more restraining mechanisms configured to restrain at least lateral movement of the ridge up to a threshold force and to deform after the threshold force is exceeded, the threshold force being less than a predetermined force and greater than a load testing force.

18. The fall protection module of claim 17, further comprising one or more stiffeners connected to the ridge and extending laterally therefrom.

19. The fall protection module of claim 18, wherein the one or more restraining mechanisms are one or more tabs extending from each attachment panel and configured to engage a respective stiffener of the one or more stiffeners to restrain at least lateral movement of the ridge.

20. The fall protection module of claim 18, wherein the one or more restraining mechanisms are one or more fasteners securing each attachment panel to a respective stiffener of the one or more stiffeners, wherein the fasteners are configured to fail when the threshold force is exceeded.

21. The fall protection module of claim 18, wherein the one or more restraining mechanisms are welds between each attachment panel and a respective stiffener of the one or more stiffeners, wherein the welds are configured to fail when the threshold force is exceeded.

22. The fall protection module of claim 18, wherein the one or more stiffeners are further configured to deform when a second force greater than the threshold force is applied.

23. A method for assembling a fall protection module, the method comprising:

providing one or more attachment panels connected to a respective lengthwise side of a ridge;

securing one or more stiffeners connected to a respective lengthwise side of the ridge to a corresponding attachment panel of the one or more attachment panels;

securing one or more user attachment points to the ridge;

restraining the ridge against at least lateral movement with a restraining mechanism;

wherein the restraining mechanism is configured to permit lateral movement of the ridge after a threshold force is applied.

24. The method of claim 23, wherein:

the restraining mechanism comprises one or more tabs extending from each of the attachment panels;

the step of restraining the ridge further comprises bending the tabs to engage a corresponding stiffener of the one or more stiffeners; and the one or more tabs are configured to deform when the threshold force is exceeded.

25. The method of claim 23, wherein the step of restraining the ridge comprises securing the one or more stiffeners to a respective attachment panel of the one or more attachment panels with one or more fasteners, the fasteners configured to fail when the threshold force is exceeded.

26. The method of claim 23, wherein the step of restraining the ridge comprises welding the one or more stiffeners to a respective attachment panel of the one or more attachment panels.

* * * * *